United States Patent [19]

Yagihara et al.

[11] Patent Number: 4,668,613

[45] Date of Patent: May 26, 1987

[54] SILVER HALIDE COLOR PHOTOGRAPHIC LIGHT-SENSITIVE MATERIAL

[75] Inventors: Morio Yagihara; Tsumoru Hirano; Tatsuya Yamamoto; Kei Sakanoue, all of Kanagawa, Japan

[73] Assignee: Fuji Photo Film Co. Ltd., Minami-ashigara, Japan

[21] Appl. No.: 724,866

[22] Filed: Apr. 19, 1985

Related U.S. Application Data

[63] Continuation of Ser. No. 528,840, Sep. 2, 1983, abandoned.

[30] Foreign Application Priority Data

Sep. 3, 1982 [JP] Japan ..... 57-153452

[51] Int. Cl.[4] ..... G03C 7/32

[52] U.S. Cl. ..... 430/548; 430/381

[58] Field of Search ..... 430/381, 548; 526/219.1

[56] References Cited

U.S. PATENT DOCUMENTS

| | | | |
|---|---|---|---|
| 2,500,023 | 3/1950 | Burk | 524/720 |
| 4,080,211 | 3/1978 | Van Paesschen et al. | 430/548 |
| 4,128,427 | 12/1978 | Monbaliu et al. | 430/548 |

OTHER PUBLICATIONS

Hammond et al., Journal American Chemical Society, pp. 1918–1921, May 20, 1964.

*Primary Examiner*—Mary F. Downey

[57] ABSTRACT

A silver halide color photographic light-sensitive material comprising a support having thereon a silver halide emulsion layer containing a polymer coupler which is capable of forming a dye upon coupling with an oxidation product of an aromatic primary amine developing agent and which is polymerized using a polymerization initiator represented by the following general formula (I):

(I)

wherein $R_1$ represents a straight chain or branched chain alkyl group having from 1 to 5 carbon atoms; an $R_2$ represents a straight chain or branched chain alkyl group having from 1 to 20 carbon atoms.

The polymer coupler according to the present invention has a good stability to humidity and heat during storage of the silver halide color photographic light-sensitive material containing thereof and provides decreased formation of fog in non-image areas of color photographs obtained by means of color development processing of the silver halide color photographic light-sensitive material.

37 Claims, No Drawings

SILVER HALIDE COLOR PHOTOGRAPHIC LIGHT-SENSITIVE MATERIAL

This is a continuation of application Ser. No. 528,840, filed Sept. 2, 1983, now abandoned.

FIELD OF THE INVENTION

The present invention relates to a silver halide color photographic light-sensitive material having decreased formation of fog in unexposed areas and an improved stability to humidity and heat during storage thereof by incorporating a novel polymer coupler capable of forming a dye upon coupling with an oxidation product of an aromatic primary amine developing agent into a silver halide emulsion layer thereof.

BACKGROUND OF THE INVENTION

It is well known that upon the color development of a silver halide photographic light-sensitive material, after exposure, an oxidized aromatic primary amine developing agent can be reacted with a dye forming coupler to obtain a color image.

It is also known that, for the color development of a silver halide color photographic material, an oxidized aromatic primary amine color developing agent can be reacted with a coupler to form a dye such as an indophenol, an indoaniline, an indamine, an azomethine, a phenoxazine, a phenazine, and the like, thus forming a color image. In this procedure, the subtractive color process is ordinarily used for color reproduction, and silver halide emulsions which are selectively sensitive to blue, green and red light, and yellow, magenta and cyan color image formers, which are respectively the complementary colors of blue, green and red, are employed. For example, a coupler of the acylacetanilide or benzoylmethane type is used for forming a yellow color image; a coupler of the pyrazolone, pyrazolobenzimidazole, cyanoacetophenone or indazolone type is generally used for forming a magenta color image; and a phenolic coupler, such as a phenol and a naphthol, is generally used for forming a cyan color image.

Color couplers must satisfy various requirements. For example, it is necessary that they have a good spectral property and provide a dye image having excellent stability to light, temperature, and humidity for a long period of time upon color development.

It is also required in a multilayer color photographic light-sensitive material that each coupler is fixed in a layer separated from each other in order to reduce color mixing and improve color reproduction. Many methods for rendering a coupler diffusion-resistant are known. One method is to introduce a long chain aliphatic group into a coupler molecule in order to prevent diffusion. Couplers according to such a method require a step of addition to an aqueous gelatin solution by solubilizing in alkali, or a step of dispersing in an aqueous gelatin solution by dissolving in an organic solvent having a high boiling point, since the couplers are immiscible with an aqueous gelatin solution. Such color couplers may cause crystal formation in a photographic emulsion. Furthermore, when using an organic solvent having a high boiling point, a large amount of gelatin must be employed since the organic solvent having a high boiling point softens an emulsion layer. Consequently, this increases the thickness of the material even though it is desirable to reduce the thickness of the emulsion layer.

Another method for rendering a coupler diffusion-resistant is to utilize a polymer coupler obtained by polymerization of a monomeric coupler in the form of a latex. An example of a method of adding a polymer coupler in a latex form to a hydrophilic colloid composition is a method in which a latex prepared by an emulsion polymerization method is directly added to a gelatino silver halide emulsion and a method in which an oleophilic polymer coupler obtained by polvmerization of a monomeric coupler is dispersed in a latex form in an aqueous gelatin solution. Some examples of the former emulsion polymerization methods include an emulsion polymerization method in an aqueous gelatin phase as described in U.S. Pat. No. 3,370,952 and an emulsion polymerization method in water as described in U.S. Pat. No. 4,080,211. An example of the latter method in which an oleophilic polymer coupler is dispersed in a latex form is described in U.S. Pat. No. 3,451,820. The method of adding a polymer coupler in a latex form to a hydrophilic colloid composition has many advantages in comparison with other methods. For example, the deterioration of strength of the film formed is prevented, because the hydrophobic substance is in a latex form. Also, since the latex can contain coupler monomers in a high concentration, it is easy to incorporate couplers in a high concentration into a photographic emulsion, and the thickness of the emulsion layer can be reduced and, thus, the sharpness is improved because the increase of viscosity is small. Furthermore, color mixing is prevented, since a polymer coupler is completely immobilized and the crystallization of couplers in the emulsion layer is small.

With respect to the addition of these polymer couplers in a latex form to a gelatino silver halide emulsion, there are described, for example, 4-equivalent magenta polymer coupler latexes and methods of preparation thereof in U.S. Pat. No. 4,080,211, British Pat. No. 1,247,688, and U.S. Pat. No. 3,451,820, copolymer latexes with a competing coupler in West German Pat. No. 2,725,591 and U.S. Pat. No. 3,926,436 and cyan polymer coupler latexes in U.S. Pat. No. 3,767,412 and *Research Disclosure*, No. 21728 (1982).

However, these latexes of polymer couplers have problems to be dissolved as well as many excellent features as described above. It should be noted that it has been strongly desired to reduce the formation of fog in unexposed areas and the stability to humidity and heat during storage. The problems include the following:

1. The fog in unexposed areas of color photographs obtained by color development processing is high.

2. The stability tb humidity and heat in the photographic light-sensitive material during storage is poor, and thus sensitivity and gamma of the dye image formed are low.

SUMMARY OF THE INVENTION

Therefore, an object of the present invention is to provide a latex of polymer coupler which prevents the formation of fog in unexposed areas of color photographs obtained by color development processing.

Another object of the present invention is to provide a latex of polymer coupler having a good stability to humidity and heat in the photographic light-sensitive material during storage thereof.

Other objects of the present invention will be apparent from the following detailed description and examples.

As a result of extensive investigations, it has now been found that these objects of the present invention are accomplished by the use of a latex of polymer coupler polymerized using a polymerization initiator represented by the following general formula (I):

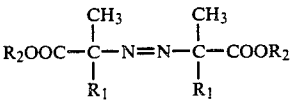

(I)

wherein $R_1$ represents a straight chain or branched chain alkyl group having from 1 to 5 carbon atoms (for example, a methyl group, an ethyl group, an isobutyl group, etc.); and $R_2$ represents a straight chain or branched chain alkyl group having from 1 to 20 carbon atoms (for example, a methyl group, an ethyl group, a propyl group, an isopropyl group, an n-butyl group, an isobutyl group, an n-pentyl group, an n-octyl group, etc.).

In more detail, the objects of the invention can be accomplished with a color photographic light-sensitive material comprising a support having thereon at least one silver halide emulsion layer containing a latex of polymer coupler polymerized using a polymerization initiator represented by the above-described general formula (I).

DETAILED DESCRIPTION OF THE INVENTION

The polymer coupler which can be employed in the present invention includes a polymer having a repeating unit represented by the general formula (III) described below which is derived from a monomer coupler represented by the general formula (II) described below, and a copolymer of a monomer coupler represented by the general formula (II) and at least one non-color forming unit containing at least one ethylene group which does not have an ability of oxidative coupling with an aromatic primary amine developing agent. Two or more kinds of the monomer couplers can be polymerized together.

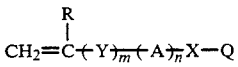

(II)

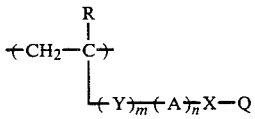

(III)

In the above-described general formulae (II) and (III), R represents a hydrogen atom, a lower alkyl group having from 1 to 4 carbon atoms or a chlorine atom; X represents—CONH—, —NHCONH—, —NHCOO—, —COO—, —$SO_2$—, —CO— or —O—; Y represents—CONH—or—COO—; A represents a straight chain or a branched chain alkylene group having from 1 to 10 carbon atoms, which may be unsubstituted or substituted, an aralkylene group having 7 to 10 carbon atoms, which may be unsubstituted or substituted, or an arylene group having 6 to 10 carbon atoms, which may be unsubstituted or substituted. Examples of the alkylene group for A include a methylene group, a methylmethylene group, a dimethylmethylene group, a dimethylene group, a trimethylene group, a tetramethylene group, a pentamethylene group, a hexamethylene group, a decylmethylene group, etc. Examples of the aralkylene group for A include a benzylidene group, etc. Examples of the arylene group for A include a phenylene group, a naphthylene group, etc. Q represents a cyan color forming coupler residue, a magenta color forming coupler residue or a yellow color forming coupler residue each of which is capable of forming a dye upon coupling with an oxidation product of an aromatic primary amine developing agent. m represents 0 or 1; and n represents 0 or 1.

Substituents for the alkylene group, the aralkylene group or the arylene group represented by A include an aryl group having 6 to 22 carbon atoms (for example, a phenyl group, etc.), a nitro group, a hydroxy group, a cyano group, a sulfo group, an alkoxy group having 1 to 22 carbon atoms (for example, a methoxy group, etc.), an aryloxy group having 6 to 22 carbon atoms (for example, a phenoxy group, etc.), an acyloxy group having 1 to 22 carbon atoms (for example, an acetoxy group, etc.), an acylamino group having 1 to 22 carbon atoms (for example, an acetylamino group, etc.), a sulfonamido group having 1 to 22 carbon atoms (for example, a methanesulfonamido group, etc.), a sulfamoyl group having 1 to 22 carbon atoms (for example, a methylsulfamoyl group, etc.), a halogen atom (for example, a fluorine atom, a chlorine atom, a bromine atom, etc.), a carboxy group, a carbamoyl group having 1 to 22 carbon atoms (for example, a methylcarbamoyl group, etc.), an alkoxycarbonyl group having 2 to 22 carbon atoms (for example, a methoxycarbonyl group, etc.), a sulfonyl group having 1 to 22 carbon atoms (for example, a methylsulfonyl group, etc.), and the like. When two or more substituents are present, they may be the same or different.

Of the cyan color forming coupler residues represented by Q, a phenol type cyan color forming coupler residue represented by the general formula (IV) described below and a naphthol type cyan color forming coupler residue represented by the general formula (V) described below are preferred.

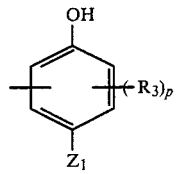

(IV)

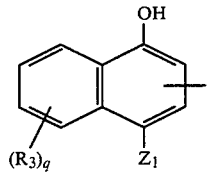

(V)

wherein $R_3$ represents an alkyl group having 1 to 22 carbon atoms, an alkenyl group having 2 to 22 carbon atoms, an alkoxy group having 1 to 22 carbon atoms, an alkoxycarbonyl group having 2 to 22 carbon atoms, a halogen atom, an alkoxycarbamoyl group having 2 to 22 carbon atoms, an aliphatic amido group having 1 to 22 carbon atoms, an alkylsulfamoyl group having 1 to 22 carbon atoms, an alkylsulfonamido group having 1 to 22 carbon atoms, an alkylureido group having 2 to 22 carbon atoms, an arylcarbamoyl group having 7 to 22 carbon atoms, an arylamido group having 6 to 22 carbon atoms, an arylsulfamoyl group having 6 to 22 carbon atoms, an arylsulfonamido group having 6 to 22 carbon atoms, or an arylureido group having 7 to 22 carbon atoms. When two or more substituents are present, they may be the same or different. p represents 0 or an integer of from 1 to 3; and q represents 0 or an integer of from 1 to 4. $Z_1$ represents a hydrogen atom, a halogen atom, a sulfo group, an acyloxy group having 1 to 22 carbon atoms, an alkoxy group having 1 to 22 carbon atoms, an aryloxy group having 6 to 22 carbon atoms, a heterocyclic oxy group, an alkylthio group having 1 to 22 carbon atoms, an arylthio group having 6 to 22 carbon atoms, or a heterocyclic thio group. These groups may be substituted. Examples of the substituents for the group represented by $Z_1$ include an aryl group having 6 to 22 carbon atoms (for example, a phenyl group, etc.), a nitro group, a hydroxy group, a cyano group, a sulfo group, an alkoxy group having 1 to 22 carbon atoms (for example, a methoxy group, etc.), an aryloxy group having 6 to 22 carbon atoms (for example, a phenoxy group, etc.), an acyloxy group having 1 to 22 carbon atoms (for example, an acetoxy group, etc.), an acylamino group having 1 to 22 carbon atoms (for example, an acetylamino group, etc.), an alkylsulfonamido group having 1 to 22 carbon atoms (for example, a methanesulfonamido group, etc.), an alkylsulfamoyl group having 1 to 22 carbon atoms (for example, a methylsulfamoyl group, etc.), a halogen atom (for example, a fluorine atom, a chlorine atom, a bromine atcm, etc.), a carboxy group, an alkylcarbamoyl group having 2 to 22 carbon atoms (for example, a methylcarbamoyl group, etc.), an alkoxycarbonyl group having 2 to 22 carbon atoms (for example, a methoxycarbonyl group, etc.), an alkylsulfonyl group having 1 to 22 carbon atoms (for example, a methylsulfonyl group, etc.), an alkylthio group having 1 to 22 carbon atoms (for example, a $\beta$-carboxyethylthio group, etc.), and the like. When two or more substituents are present, they may be the same or different.

Of the magenta color forming coupler residues represented by Q, a pyrazolone type magenta color forming coupler residue represented by the general formula (VI) described below and an indazolone type magenta color forming coupler residue are preferred.

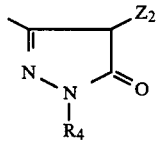

(VI)

wherein $R_4$ represents a group which is well known for the substituent on the 1-position of a 2-pyrazolin-5-one coupler, for example, an alkyl group having 1 to 22 carbon atoms, which may be substituted (for example, a haloalkyl group such as a fluoroalkyl group, a cyanoalkyl group, a benzylalkyl group, etc.), an aryl group having 6 to 22 carbon atoms, which may be substituted. Substituents for the aryl group include an alkyl group having 1 to 22 carbon atoms (for example, a methyl group, an ethyl group, etc.), an alkoxy group having 1 to 22 carbon atoms (for example, a methoxy group, an ethoxy group, etc.), an aryloxy group having 6 to 22 carbon atoms (for example, a phenoxy group, etc.), an alkoxycarbonyl group having 2 to 22 carbon atoms (for example, a methoxycarbonyl group, etc.), an acylamino group having 2 to 22 carbon atoms (for example, an acetylamino group, etc.), a carbamoyl group having 1 to 22 carbon atoms, an alkylcarbamoyl group having 2 to 22 carbon atoms (for example, a methylcarbamoyl group, an ethylcarbamoyl group, etc.), a dialkylcarbamoyl group having 3 to 22 carbon atoms (for example, a dimethylcarbamoyl group, etc.), an arylcarbamoyl group having 7 to 22 carbon atoms (for example, a phenylcarbamoyl group, etc.), an alkylsulfonyl group having 1 to 22 carbon atoms (for example, a methylsulfonyl group, etc.), an arylsulfonyl group having 6 to 22 carbon atoms (for example, a phenylsulfonyl group, etc.), an alkylsulfonamido group having 1 to 22 carbon atoms (for example, a methanesulfonamido group, etc.), an arylsulfonamido group having 6 to 22 carbon atoms (for example, a phenylsulfonamido group, etc.), a sulfamoyl group, an alkylsulfamoyl group having 1 to 22 carbon atoms (for example, an ethylsulfamoyl group, etc.), a dialkylsulfamoyl group having 2 to 22 carbon atoms (for example, a dimethylsulfamoyl group, etc.), an alkylthio group having 1 to 22 carbon atoms (for example, a methylthio group, etc.), an arylthio group having 6 to 22 carbon atoms (for example, a phenylthio group, etc.), a cyano group, a nitro group, a halogen atom (for example, a fluorine atom, a chlorine atom, a bromine atom, etc.), and the like. When two or more substituents are present, they may be the same or different.

Particularly preferred substituents include a halogen atom, an alkyl group, an alkoxy group, an alkoxycarbonyl group and a cyano group.

$Z_2$ represents a hydrogen atom or a releasable group containing an oxygen atom, a nitrogen atom or a sulfur atom through which it is bonded to the coupling position. When $Z_2$ represents the releasable group containing an oxygen atom, a nitrogen atom or a sulfur atom through which it is bonded to the coupling position, these atoms are bonded to an alkyl group having 1 to 22 carbon atoms, an aryl group having 6 to 22 carbon atoms, an alkylsulfonyl group having 1 to 22 carbon atoms, an arylsulfonyl group having 6 to 22 carbon atoms, an alkylcarbonyl group having 2 to 22 carbon atoms, an arylcarbonyl group having 7 to 22 carbon atoms or a heterocyclic group wherein the alkyl group, the aryl group and the heterocyclic group may be substituted with a group defined as the above-described substituent for the aryl group represented by $R_4$, and when $Z_2$ represents the releasable group containing a nitrogen atom, it represents a releasable group which forms a 5-membered or 6-membered ring together with the nitrogen atom (for example, an imidazolyl group, a pyrazolyl group, a triazolyl group, a tetrazolyl group, etc.).

Of the yellow color forming coupler residues represented by Q, an acylacetanilide type yellow color forming coupler residue, and particularly, a pivaloylacetanilide type yellow color forming coupler residue represented by the general formula (VII) described below and a benzoylacetanilide type yellow color forming coupler residue represented by the general formula (VIII) or (IX) described below are preferred.

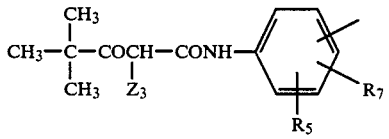

(VII)

-continued (VIII)

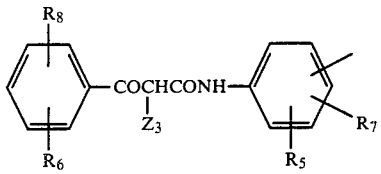

(IX)

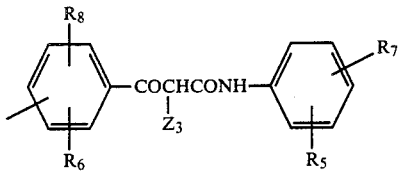

wherein $R_5$, $R_6$, $R_7$ and $R_8$ each represents a hydrogen atom or a group which is well known for the substituent on the yellow color forming coupler residue, for example, an alkyl group having 1 to 22 carbon atoms, an alkenyl group having 2 to 22 carbon atoms, an alkoxy group having 1 to 22 carbon atoms, an alkoxycarbonyl group having 2 to 22 carbon atoms, a halogen atom, an alkoxycarbamoyl group having 2 to 22 carbon atoms, an aliphatic amido group having 1 to 22 carbon atoms, an alkylsulfamoyl group having 1 to 22 carbon atoms, an alkylsulfonamido group having 1 to 22 carbon atoms, an alkylureido group having 2 to 22 carbon atoms, an alkyl-substituted succinimido group having 1 to 22 carbon atoms in the alkyl moiety, an aryloxy group having 6 to 22 carbon atoms, an aryloxycarbonyl group having 7 to 22 carbon atoms, an arylcarbamoyl group having 7 to 22 carbon atoms, an arylamido group having 6 to 22 carbon atoms, an arylsulfamoyl group having 6 to 22 carbon atoms, an arylsulfonamido group having 6 to 22 carbon atoms, an arylureido group having 7 to 22 carbon atoms, a carboxy group, a sulfo group, a nitro group, a cyano group, a thiocyano group, and the like. These substituents may be the same or different.

$Z_3$ represents a hydrogen atom or a group represented by the general formula (X), (XI), (XII) or (XIII) described below.

(X)

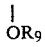

wherein $R_9$ represents an aryl group having 6 to 22 carbon atoms, which may be substituted or a heterocyclic group which may be substituted, (XI)

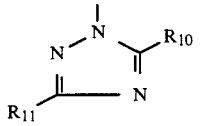

(XII)

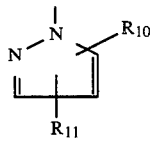

wherein $R_{10}$ and $R_{11}$, which may be the same or different, each represents a hydrogen atom, a halogen atom, a carboxylic acid ester group having 2 to 22 carbon atoms, an amino group having 1 to 22 carbon atoms, an alkyl group having 1 to 22 carbon atoms, an alkylthio group having 1 to 22carbon atoms, an alkoxy group having 1 to 22 carbon atoms, an alkylsulfonyl group having 1 to 22 carbon atoms, an alkylsulfinyl group having 1 to 22 carbon atoms, a carboxylic acid group having 1 to 22 carbon atoms, a sulfonic acid group having 1 to 22 carbon atoms, an unsubstituted or substituted phenyl group or an unsubstituted or substituted heterocyclic group, (XIII)

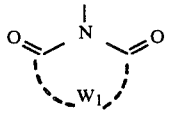

wherein $W_1$ represents non-metallic atoms necessary to form a 4-membered, 5-membered or 6-membered ring together with

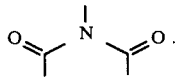

Of the groups represented by the general formula (XIII), groups represented by the following general formulae (XIV), (XV) and (XVI) are preferred.

(XIV)

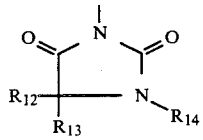

(XV)

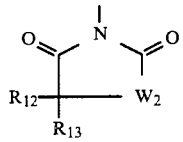

(XVI)

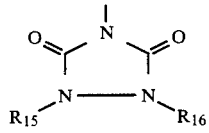

wherein $R_{12}$ and $R_{13}$ each represents a hydrogen atom, an alkyl group having 1 to 22 carbon atoms, an aryl group having 6 to 22 carbon atoms, an alkoxy group having 1 to 22 carbon atoms, an aryloxy group having 6 to 22 carbon atoms, or a hydroxy group; $R_{14}$, $R_{15}$ and $R_{16}$ each represents a hydrogen atoms, an alkyl group having 1 to 22 carbon atoms, an aryl group having 6 to 22 carbon atoms, an aralkyl group having 7 to 22 carbon atoms, or an acyl group having 1 to 22 carbon atoms; and $W_2$ represents an oxygen atom or a sulfur atom.

Examples of the non-color forming ethylenic monomer which does not couple with the oxidation product of an aromatic primary amine developing agent include an acrylic acid, for example, acrylic acid, α-chloroacrylic acid, an alkylacrylic acid such as methacrylic acid, etc., an ester and an amide, derived therefrom (for example, acrylamide, n-butylacrylamide, t-butylacrylamide, diacetoneacrylamide, methacrylamide, methyl acrylate, ethyl acrylate, n-propyl acrylate, n-butyl acrylate, t-butylacrylate, isobutyl acrylate, 2-ethylhexyl acrylate, n-octyl acrylate, lauryl acrylate, methyl methacrylate, ethyl methacrylate, n-butyl methacrylate, β-hydroxyethyl methacrylate, 2-acrylamido-2-methylpropanesulfonic acid, etc.), methylene bisacrylamide, a vinyl ester (for example, vinyl acetate, vinyl propionate, vinyl laurate, etc.), acrylonitrile, methacrylonitrile, an aromatic vinyl compound (for example, styrene and a derivative thereof, for example, vinyltoluene, divinylbenzene, vinylacetophenone, sulfostyrene, etc.), itaconic acid, citraconic acid, crotonic acid, vinylidene chloride, a vinyl alkyl ether (for example, vinyl ethyl ether, etc.), maleic acid, maleic anhydride, an ester of maleic acid, N-vinyl-2-pyrrolidone, N-vinylpyridine, 2- or 4-vinylpyridine, etc.

Of these monomers, an ester of acrylic acid, an ester of methacrylic acid and an ester of maleic acid are particularly preferred.

Two or more non-color forming ethylenically unsaturated monomers described above can be used together with. For example, a combination of n-butyl acrylate and methyl acrylate, styrene and methacrylic acid, methyl acrylate and diacetoneacrylamide, etc., can be used.

The non-color forming ethylenically unsaturated monomer which is used to copolymerize with the solid water-insoluble monomer coupler can be selected so that the copolymer to be formed possesses good physical properties and/or chemical properties, for example, solubility, compatibility with a binder such as gelatin in a photographic colloid composition, flexibility, heat stability, etc., as well known in the field of polymer color couplers.

The polymer coupler which can be used in the present invention is preferably oleophilic and it is particularly preferred to use it in the form of a latex.

With respect to the method in which an oleophilic polymer coupler is dispersed in a latex form in an aqueous gelatin solution, the method as described in U.S. Pat. No. 3,451,820 can be employed. The method can be applied to preparation of homopolymers and preparation of copolymers.

Solvents which can be used in polymerization of the oleophilic polymer coupler are preferably those which can usually be admixed with monomers to be used without limitation, are good solvent for the oleophilic polymer coupler formed, do not react with initiators to be used and do not interrupt usual actions in free radical addition polymerization. Specific examples of the solvent which can be used include an aromatic hydrocarbon (for example, benzene, toluene, etc.), a hydrocarbon (for example, n-hexane, etc.), an alcohol (for example, methanol, ethanol, isopropanol, tert-butanol, etc.), a ketone (for example, acetone, methyl ethyl ketone, etc.), a cyclic ether (for example, tetrahydrofuran, dioxane, etc.), an ester (for example, ethyl acetate, etc.), a chlorinated hydrocarbon (for example, methylene chloride, chloroform, etc.), an amide (for example, dimethylformamide, dimethylacetamide, etc.), a sulfoxide (for example, dimethyl sulfoxide, etc.), a nitrile (for example, acetonitrile, etc.), and a mixture thereof.

Temperature of polymerization is determined in connection with other factors, for example, a molecular weight of a polymer to be formed, a kind of an initiator, etc. It is possible to carry out the polymerization in a temperature range of from 0° C. or lower to 100° C. or higher, and preferably, in a range of from 30° C. to 100° C.

Further, an organic solvent which is used for dissolving an oleophilic polymer coupler in the case where the oleophilic polymer coupler is dispersed in a latex form in an aqueous gelatin solution is removed from the mixture before coating of the dispersion solution or by vaporization during drying of the dispersion solution coated, although the latter is less preferable. With respect to removing the solvent, a method in which the solvent is removed by washing a gelatin noodle with water is applied when the solvent is water-soluble to some extent, or a spray drying method, a vacuum purging method or a steam purging method can be employed for removing the solvent.

Examples of the organic solvents which can be removed include, for example, an ester (for example, a lower alkyl ester, etc.), a lower alkyl ether, a ketone, a halogenated hydrocarbon (for example, methylene chloride, trichloroethylene, a fluorinated hydrocarbon, etc.), an alcohol (for example, n-butyl alcohol, octyl alcohol, etc.), and a mixture thereof.

Any type of dispersing agent can be used in the dispersion of the oleophilic polymer coupler. Ionic surface active agents, and particularly anionic surface active agents are preferred. Amphoteric surface active agents such as C-cetyl betaine, an N-alkylaminopropionate, an N-alkyliminodipropionate, etc., can also be used.

In order to control the color hue of a dye formed from a polymer coupler and the oxidation product of an aromatic primary amine developing agent and to improve the bending property of the emulsion coated, a permanent solvent, that is, a water-immiscible organic solvent having a high boiling point (i.e., above 200° C.), may be added. Furthermore, it is desirable to use the permanent solvent in a relatively low concentration in order to reduce the thickness of a final emulsion layer as much as possible to obtain good sharpness.

It is preferable that the ratio of the color forming portion in the polymer coupler is usually from 5 to 80% by weight. Particularly, a ratio from 20 to 70% by weight is preferred in view of color reproducibility, color forming property and stability. In this case, an equivalent molecular weight, that is, a gram number of the polymer containing 1 mol of a monomer coupler, is preferably from about 250 to 4,000, but it is not limited thereto.

A coating amount of the polymer coupler in the present invention is determined so that it is present in a range of from $2\times10^{-3}$ mol to $5\times10^{-1}$ mol, and preferably, from $1\times10^{-2}$ mol to $5\times10^{-1}$ mol per mol of silver based on the amount of the color forming unit.

Examples of the monomer couplers suitable for use in the preparation of the polymer couplers according to the present invention and synthesis methods thereof are described in various literature, for example, Belgian Pat. Nos. 584,494, 602,516 and 669,971, British Pat. Nos. 967,503, 1,130,581, 1,247,688 and 1,269,355, GB-A-2,092,573, U.S. Pat. Nos. 3,356,686 and 3,767,412 (incorporated herein by reference to disclose such monomer couplers), Japanese Patent Application (OPI) Nos. 28745/83, 10738/83, and 42044/83 (the term "OPI" as used herein refers to a "published unexamined Japanese patent application"), etc.

Representative specific examples of the monomer couplers used in the present invention are set forth below, but the present invention is not to be construed as being limited thereto.

(C-1)
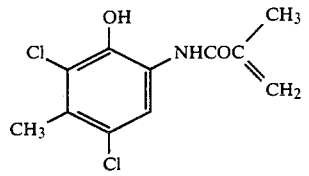
(C-2)
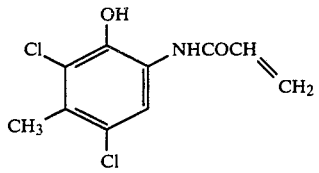
(C-3)
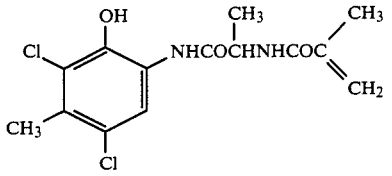
(C-4)
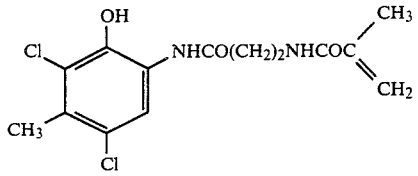
(C-5)
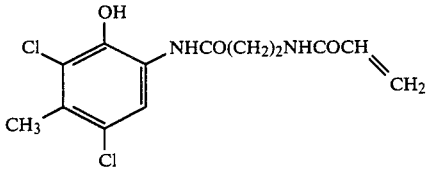
(C-6)
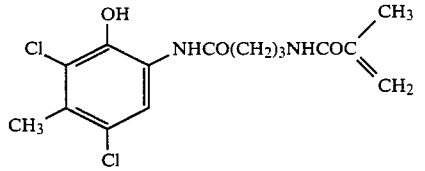
(C-7)
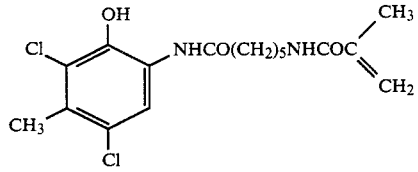
(C-8)
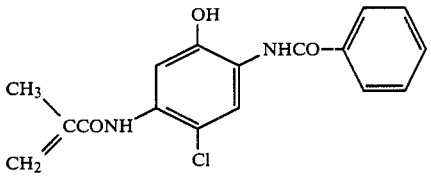
(C-9)
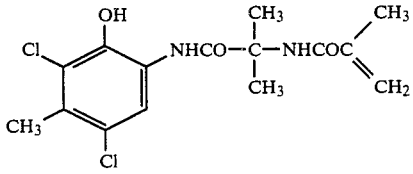
-continued
(C-10)
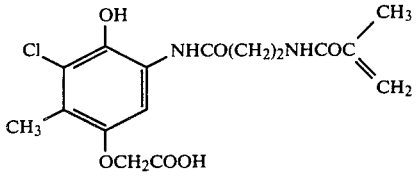
(C-11)
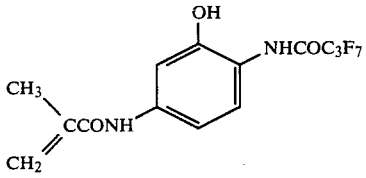
(C-12)
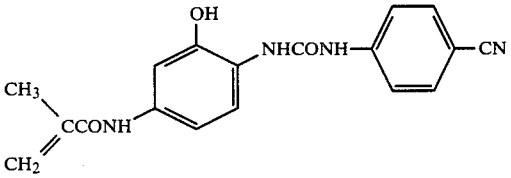
(C-13)
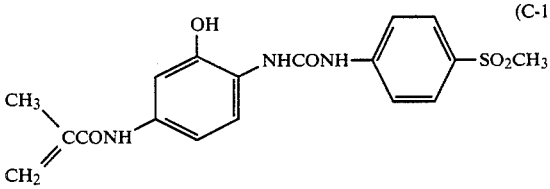
(C-14)
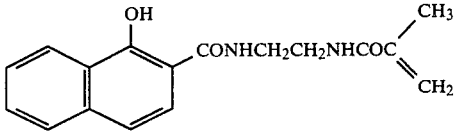
(C-15)
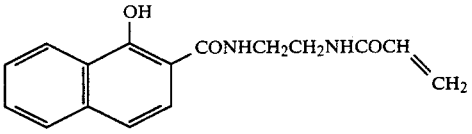
(M-1)
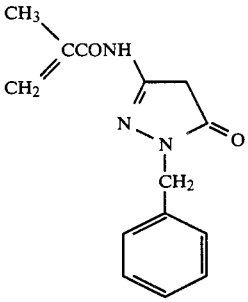
(M-2)
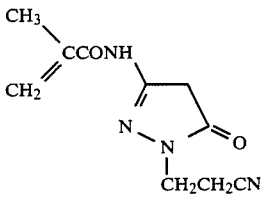

-continued
(M-3)
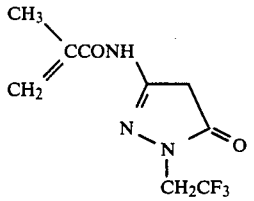
(M-4)
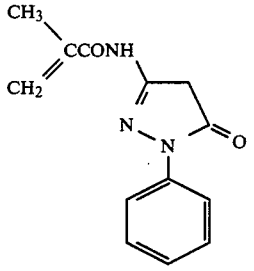
(M-5)
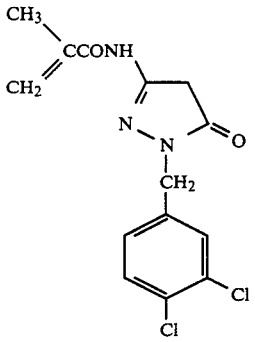
(M-6)
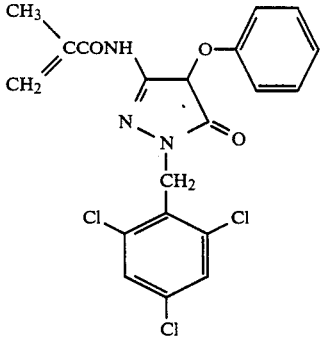
(M-7)
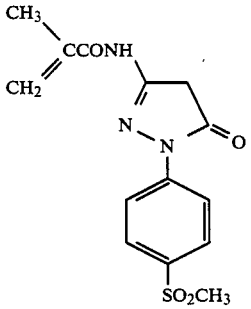
-continued
(M-8)
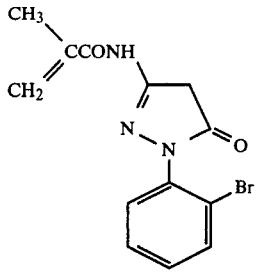
(M-9)
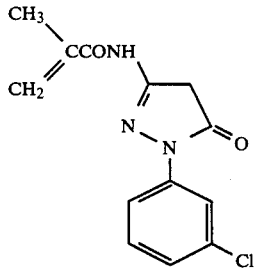
(M-10)
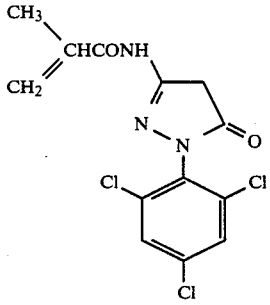
(M-11)
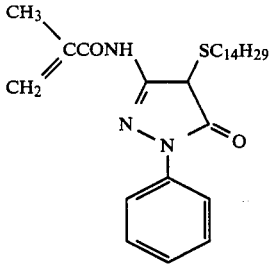
(M-12)
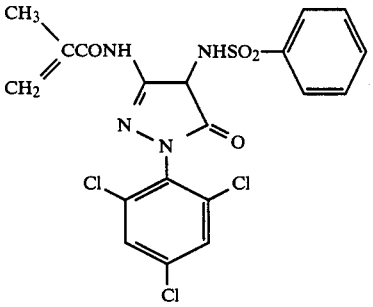

-continued
(M-13)
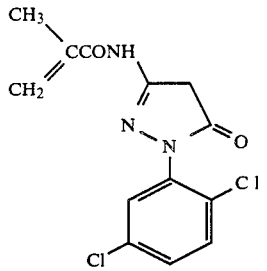
(M-14)
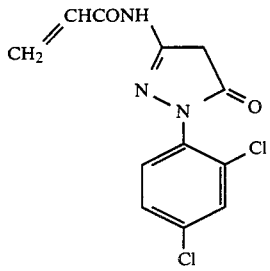
(M-15)
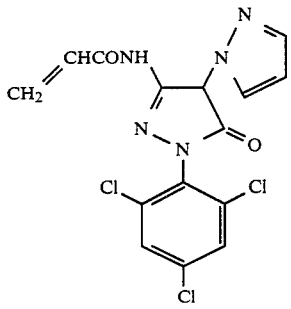
(M-16)
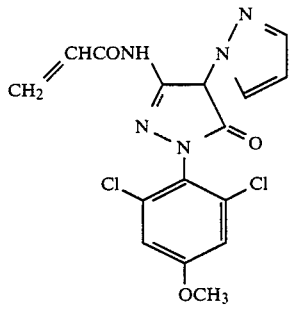
(M-17)
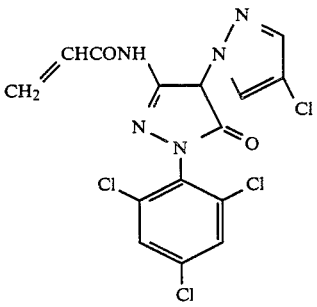
-continued
(M-18)
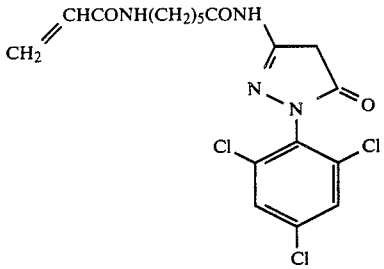
(M-19)
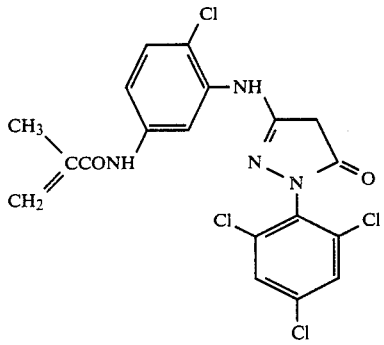
(M-20)
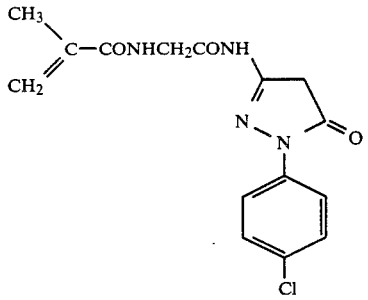
(M-21)
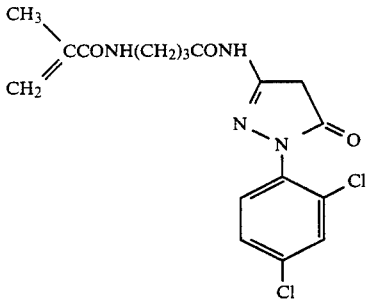
(M-22)
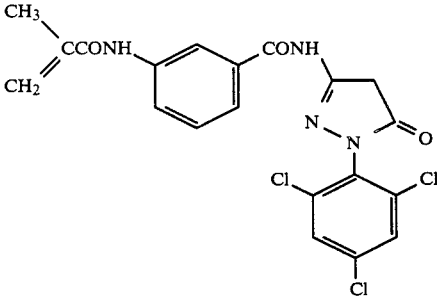

-continued
(M-23)
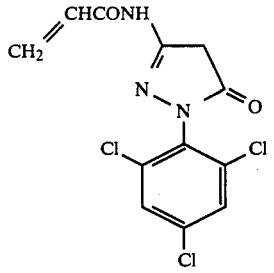
(M-24)
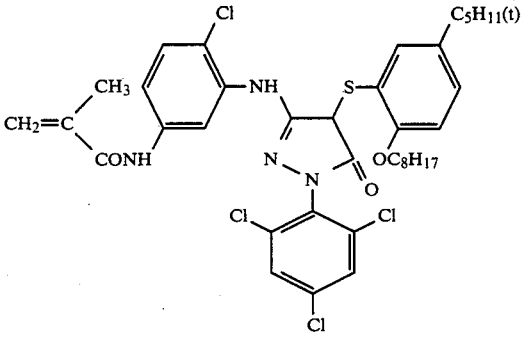
(M-25)
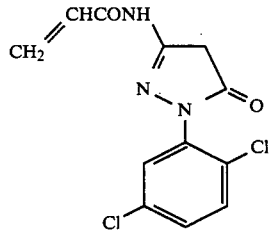
(M-26)
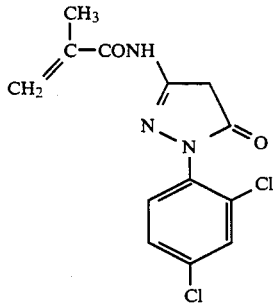
(M-27)
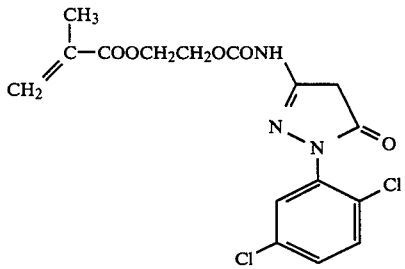
-continued
(M-28)
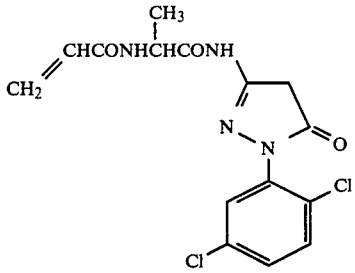
(M-29)
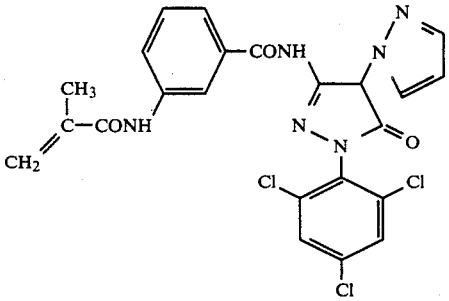
(M-30)
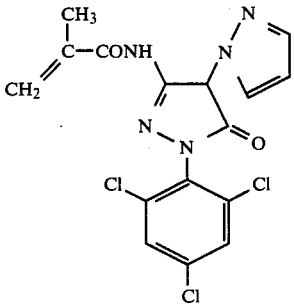
(M-31)
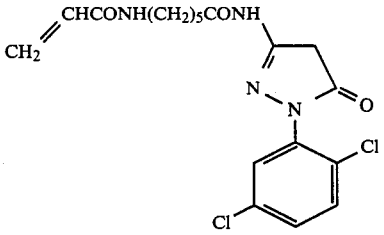
(Y-1)
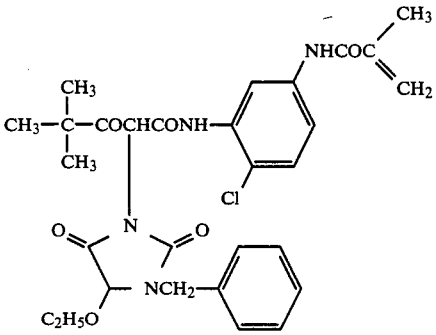

-continued
(Y-2)
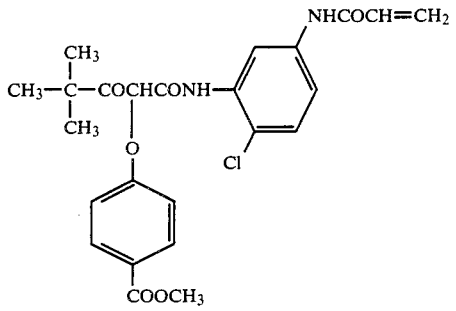
(Y-3)
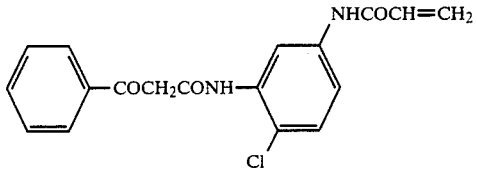
(Y-4)
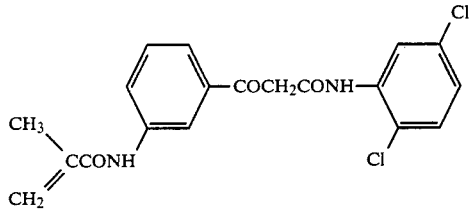
(Y-5)
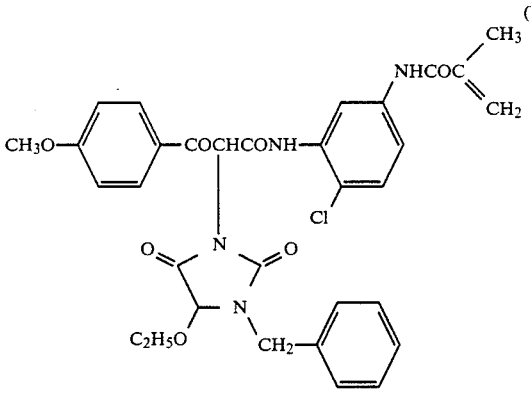
(Y-6)
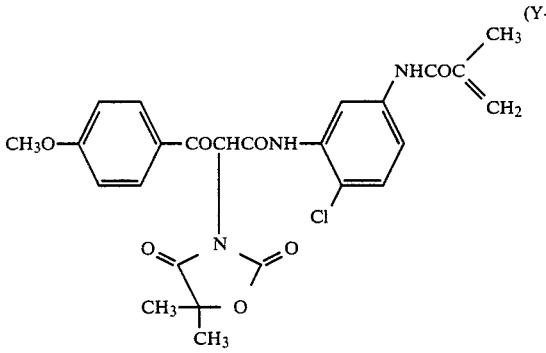
-continued
(Y-7)
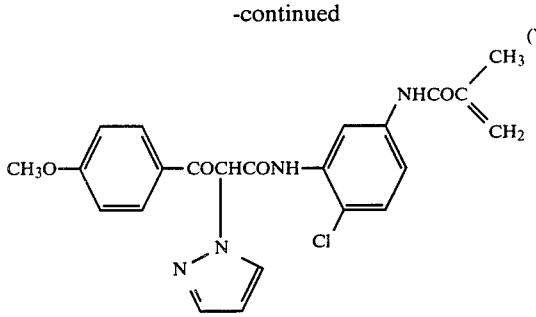
(Y-8)
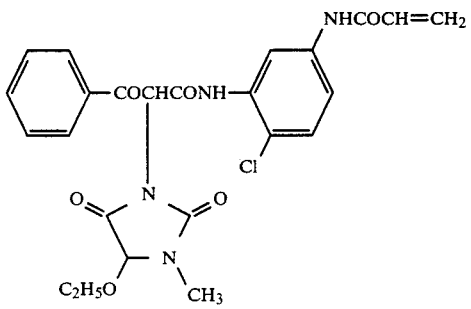
(Y-9)
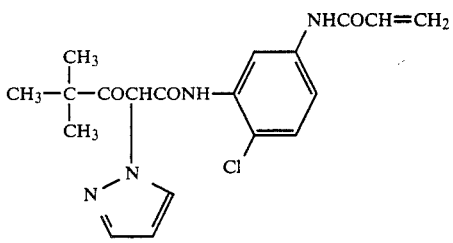
(Y-10)
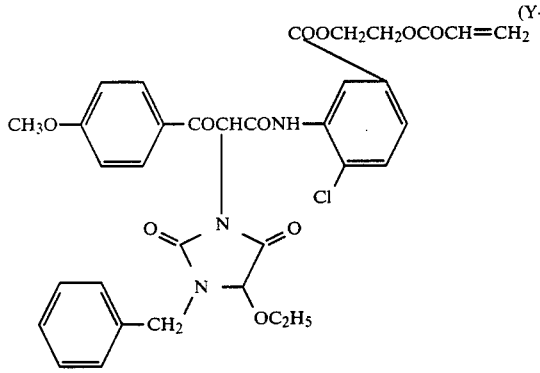
(Y-11)
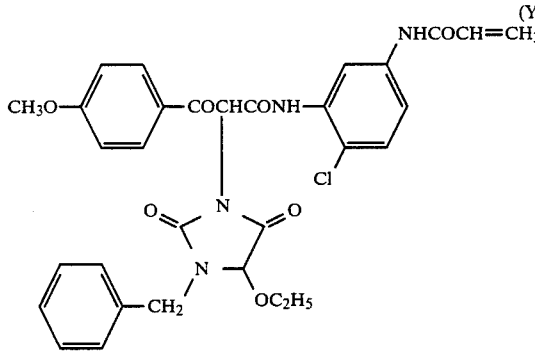
Examples of the polymerization initiators suitable for use in the preparation of the polymer couplers according to the present invention are described in various literatures, for example, *J. Magn. Resonance,* Vol. 10, No. 2, pages 203 to 210 (1973), *Collect. Czech. Chem. Commun.,* Vol. 42, No. 8, pages 2394 to 2400 (1977), Japanese Patent Application (OPI) Nos. 125317/74 and 118784/74, *Zh. Org. Khim.,* Vol. 7, No. 11, pages 2263 to 2267 (1971), *Collect. Czech. Chem. Comm.,* Vol. 33, page 1122 (1968), *J. Am. Chem. Soc.,* Vol. 88, page 1918 (1964), etc.

Specific examples of the polymerization initiator used in the present invention are set forth below, but the present invention is not to be construed as being limited thereto.

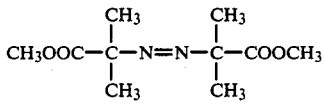
(1)

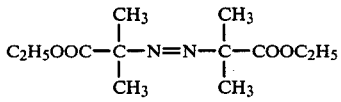
(2)

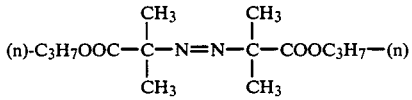
(3)

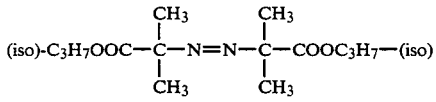
(4)

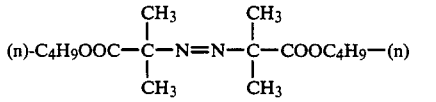
(5)

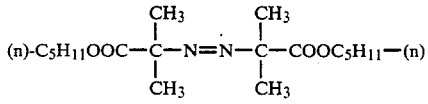
(6)

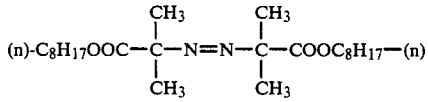
(7)

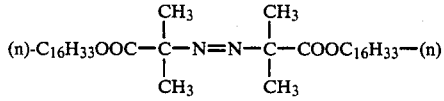
(8)

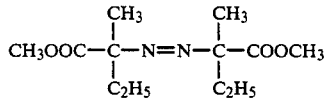
(9)

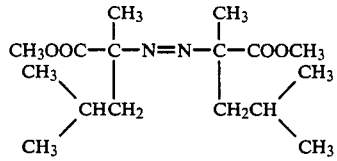
(10)

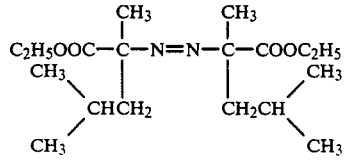
(11)

-continued

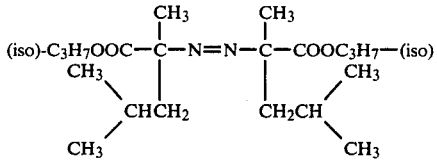
(12)

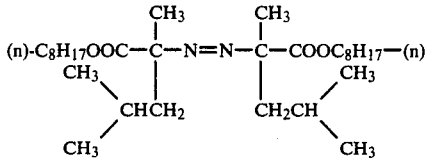
(13)

Representative synthesis examples of the polymer couplers used in the present invention are described in the following.

SYNTHESIS EXAMPLE 1

Synthesis of copolymer coupler of 6-methacrylamido-2,4-dichloro-3-methylphenol [Monomer Coupler (C-1)] and methyl acrylate [Polymer Coupler (A)]

A mixture composed of 20 g of Monomer Coupler (C-1), 20 g of methyl acrylate and 200 ml of dioxane was heated to 80° C. while introducing nitrogen gas. To the mixture was added 10 ml of a dioxane solution containing 400 mg of dimethyl 2,2'-azobisisobutyrate [Polymerization Initiator (1)] dissolved to initiate polymerization. After reacting for 4 hours, the reaction temperature was raised to 100° C. and the mixture was further reacted for 2 hours. The reaction solution was then cooled and poured into 1 liter of water. The solid thus deposited were collected by filtration. By drying the solid under a reduced pressure with heating, 37.6 g of Polymer Coupler (A) was obtained. It was found that the polymer coupler contained 52.1% of Monomer Coupler (C-1) in the copolymer synthesized as the result of chlorine analysis.

A method for dispersing Polymer Coupler (A) in an aqueous gelatin solution in the form of a latex is described in the following.

Two solutions (a) and (b) were prepared in the following manner.

Solution (a): 200 g of a 3.0% by weight aqueous solution of bone gelatin (pH of 5.6 at 35° C.) was heated to 38° C. and to which was added 16 ml of a 10% by weight aqueous solution of sodium lauryl sulfate.

Solution (b): 20 g of Polymer Coupler (A) described above was dissolved in 200 ml of ethyl acetate at 38° C.

Solution (b) was put into a mixer with explosion preventing equipment while stirring at a high speed to which was rapidly added solution (a). After stirring for 1 minute, the mixer was stopped and ethyl acetate was removed by distillation under a reduced pressure. Thus, the polymer coupler was dispersed in a diluted gelatin solution to prepare Polymer Coupler Latex (A').

SYNTHESIS EXAMPLE 2

Synthesis of copolymer coupler of 6-(3-methacrylamidopropanamido)-2,4-dichloro-3-methylphenol [Monomer Coupler (C-4)], methyl acrylate and diacetoneacrylamide[Polymer Coupler (B)]

A mixture composed of 50 g of Monomer Coupler (C-4), 30 g of methyl acrylate, 20 g of diacetoneacrylamide and 500 g of dioxane was heated to 85° C. while introducing nitrogen gas. To the mixture was added 20 ml of a dioxane solution containing 1.5 g of dimethyl 2,2'-azobisisobutyrate [Polymerization Initiator (1)] dissolved to initiate polymerization. After reacting for 4 hours, the reaction temperature was raised to 100° C. and the mixture was further reacted for 2 hours. The reaction solution was then cooled and poured into 3 liters of water. The solid thus deposited were collected by filtration. By drying the solid under a reduced pressure with heating, 96.4 g of Polymer Coupler (B) was obtained. It was found that the polymer coupler contained 50.9% of Monomer Coupler (C-4) in the copolymer synthesized as the result of chlorine analysis.

A method for dispersing Polymer Coupler (B) in an aqueous gelatin solution in the form of a latex is described in the following.

Two solutions (a) and (b) were prepared in the following manner.

Solution (a): 200 g of a 3.0% by weight aqueous solution of bone gelatin (pH of 5.6 at 35° C.) was heated to 38° C. and to which was added 16 ml of a 10% by weight aqueous solution of sodium lauryl sulfate.

Solution (b): 20 g of Polymer Coupler (B) described above was dissolved in 200 ml of ehtyl acetate at 38° C.

Solution (b) was put into a mixer with explosion preventing equipment while stirring at high speed and to which was rapidly added Solution (a). After stirring for 1 minute, the mixer was stopped and ethyl acetate was removed by distillation under a reduced pressure. Thus, the polymer coupler was dispersed in a diluted gelatin solution to prepare Polymer Coupler Latex (B').

SYNTHESIS EXAMPLE 3

Synthesis of copolymer coupler of 2-heptafluorobutanamido-5-methacrylamidophenol [Monomer Coupler (C-11)] and butyl acrylate [Polymer Coupler (C)]

A mixture composed of 20 g of Monomer Coupler (C-11), 20 g of butyl acrylate and 200 g of dioxane was heated to 85° C. with stirring while introducing nitrogen gas. To the mixture was added 10 ml of a dioxane solution containing 400 mg of dimethyl 2,2'-azobisisobutyrate [Polymerization Initiator (1)] dissolved to initiate polymerization. After reacting for 4 hours, the reaction temperature was raised to 100° C. and the mixture was further reacted for 3 hours at 100° C. The reaction mixture was cooled and filtered. The filtrate was poured into 2 liters of water to obtain 38.2 g white powders of the polymer. It was found that the polymer coupler contained 51.5% of Monomer Coupler (C-11) in the copolymer synthesized as the result of chlorine analysis.

A method for dispersing Polymer Coupler (C) in an aqueous gelatin solution in the form of a latex is described in the following.

Two solutions (a) and (b) were prepared in the following manner.

Solution (a): 200 g of a 3.0% by weight aqueous solution of bone gelatin (pH of 5.6 at 35° C.) was heated to 38° C. and to which was added 16 ml of a 10% by weight aqueous solution of sodium lauryl sulfite.

Solution (b): 20 g of Polymer Coupler (C) described above was dissolved in 200 ml of ethyl acetate at 38° C.

Solution (b) was put into a mixer with explosion preventing equipment while stirring at high speed and to which was rapidly added Solution (a). After stirring for 1 minute, the mixer was stopped and ethyl acetate was removed by distillation under a reduced pressure. Thus, the polymer coupler was dispersed in a diluted gelatin solution to prepare Polymer Coupler Latex (C').

SYNTHESIS EXAMPLE 4

Synthesis of copolymer coupler of 1-(2,4,6-trichlorophenyl)-3-methacrylamido-2-pyrazolin-5-one [Monomer Coupler (M-10)] and ethyl acrylate [Polymer Coupler (D)]

A mixture composed of 40 g of Monomer Coupler (M-10), 60 g of ethyl acrylate and 500 g of dioxane was heated to 80° C. while introducing nitrogen gas. To the mixture was added 20 ml of a dioxane solution containing 1 g of diethyl 2,2'-azobisisobutyrate [Polymerization Initiator (2)] dissolved to initiate polymerization. After reacting for 4 hours, the reaction temperature was raised to 100° C. and the mixture was further reacted for 2 hours. The reaction solution was then cooled and poured into 4 liters of water. The solid thus deposited was collected by filtration. By drying the solid under a reduced pressure with heating, 94.7 g of Polymer Coupler (D) was obtained. It was found that the polymer coupler contained 41.3% of Monomer Coupler (M-10) in the copolymer synthesized as the result of chlorine analysis.

A method for dispersing Polymer Coupler (D) in an aqueous gelatin solution in the form of a latex is described in the following.

Two solutions (a) and (b) were prepared in the following manner.

Solution (a): 200 g of a 3.0% by weight aqueous solution of bone gelatin (pH of 5.6 at 35° C.) was heated to 38° C. and to which was added 16 ml of a 10% by weight aqueous solution of sodium lauryl sulfate.

Solution (b): 20 g of Polymer Coupler (D) described above was dissolved in 200 ml of ethyl acetate at 38° C.

Solution (b) was put into a mixer with explosion preventing equipment while stirring at a high speed to which was rapidly added solution (a). After stirring for 1 minute, the mixer was stopped and ethyl acetate was removed by distillation under a reduced pressure. Thus, the polymer coupler was dispersed in a diluted gelatin solution to prepare Polymer Coupler Latex (D').

SYNTHESIS EXAMPLE 5

Synthesis of copolymer coupler of 1-(2,5-dichlorophenyl)-3-methacrylamido-2-pyrazolin-5-one [Monomer Coupler (M-13)] and butyl acrylate [Polymer Coupler (E)]

A mixture composed of 30 g of Monomer Coupler (M-13), 30 g of butyl acrylate and 300 g of dioxane was heated to 85° C. with stirring while introducing nitrogen gas. To the mixture was added 15 ml of a dioxane solution containing 600 mg of dimethyl 2,2'-azobisisobutyrate [Polymerization Initiator (1)], dissolved to initiate polymerization. After reacting for 4 hours, the reaction temperature was raised to 100° C.

and the mixture was further reacted for 3 hours at 100° C. The reaction mixture was cooled and filtered. The filtrate was poured into 3 liters of water to obtain 57.6 g of white powders of the polymer. It was found that the polymer coupler contained 50.2% of Monomer Coupler (M-13) in the copolymer synthesized as the result of chlorine analysis.

A method for dispersing Polymer Coupler (E) in an aqueous gelatin solution in the form of a latex is described in the following.

Two solutions (a) and (b) were prepared in the following manner.

Solution (a): 200 g of a 3.0% by weight aqueous solution of bone gelatin (pH of 5.6 at 35° C.) was heated to 38° C. and to which was added 16 ml of a 10% by weight aqueous solution of sodium lauryl sulfate.

Solution (b): 20 g of Polymer Coupler (E) described above was dissolved in 200 ml of ethyl acetate at 38° C.

Solution (b) was put into a mixer with explosion preventing equipment while stirring at high speed and to which was rapidly added Solution (a). After stirring for 1 minute, the mixer was stopped and ethyl acetate was removed by distillation under a reduced pressure. Thus, the polymer coupler was dispersed in a diluted gelatin solution to prepare Polymer Coupler Latex (E').

SYNTHESIS EXAMPLE 6

Synthesis of copolymer coupler of 2-chloro-5-acrylamido-α-(4-methoxybyenzoyl-α-(1-benzoyl-5-ethoxy-3-hydantoinyl)acetanilide [Monomer Coupler (Y-11)] and butyl acrylate [Polymer Coupler (F)]

A mixture composed of 20 g of Monomer Coupler (Y-11), 30 g of butyl acrylate and 250 g of dioxane was heated to 80° C. while introducing nitrogen gas. To the mixture was added 10 ml of a dioxane solution containing 600 mg of dimethyl 2,2-azobisisobutyrate [Polymerization Initiator (1)] dissolved to initiate polymerization. After reacting for 4 hours, the reaction temperature was raised to 100° C. and the mixture was further reacted for 2 hours. The reaction solution was cooled and poured into 2 liters of water. The solid thus deposited was collected by filtration. By drying the solid under a reduced pressure with heating, 48.4 g of Polymer Coupler (F) was obtained. It was found that the polymer coupler contained 40.6% of Monomer Coupler (Y-11) in the copolymer synthesized as the result of chlorine analysis.

A method for dispersing Polymer Coupler (F) in an aqueous gelatin solution in the form of a latex is described in the following.

Two solutions (a) and (b) were prepared in the following manner.

Solution (a): 200 g of a 3.0% by weight aqueous solution of bone gelatin (pH of 5.6 at 35° C.) was heated to 38° C. and to which was added 16 ml of a 10% by weight aqueous solution of sodium lauryl sulfate.

Solution (b): 20 g of Polymer Coupler (F) described above was dissolved in 200 ml of ethyl acetate at 38° C.

Solution (b) was put into a mixer with explosion preventing equipment while stirring at high speed and to which was rapidly added Solution (a). After stirring for 1 minute, the mixer was stopped and ethyl acetate was removed by distillation under a reduced pressure. Thus, the polymer coupler was dispersed in a diluted gelatin solution to prepare Polymer Coupler Latex (F').

SYNTHESIS EXAMPLES 7 TO 25

Using the above-described monomer couplers, Polymer Couplers (G) to (Y) described below were prepared in the same manner as described for copolymers in Synthesis Examples 1 to 6.

| Synthesis Example | Polymer Coupler | Monomer Coupler | Amount (g) | Comonomer*1 | Amount (g) | Polymerization Initiator | Monomer Coupler Unit in Polymer (wt %) |
|---|---|---|---|---|---|---|---|
| 7 | G | C-2 | 20 | MA | 20 | (1) | 53.1 |
| 8 | H | C-6 | 20 | MA | 20 | (2) | 52.8 |
| 9 | I | C-9 | 20 | MA | 12 | (1) | 51.4 |
| | | | | DAAM | 8 | | |
| 10 | J | C-12 | 20 | BA | 20 | (4) | 50.7 |
| 11 | K | C-14 | 20 | BA | 30 | (4) | 51.2 |
| 12 | L | M-4 | 20 | EA | 30 | (10) | 42.5 |
| 13 | M | M-7 | 20 | MA | 20 | (10) | 52.6 |
| 14 | N | M-13 | 20 | MA | 10 | (1) | 50.8 |
| | | | | BA | 10 | | |
| 15 | O | M-13 | 20 | EA | 20 | (1) | 51.2 |
| 16 | P | M-13 | 20 | MA | 20 | (1) | 52.6 |
| 17 | Q | M-18 | 20 | BA | 20 | (11) | 51.0 |
| 18 | R | M-19 | 20 | BA | 30 | (1) | 41.3 |
| 19 | S | M-22 | 20 | BA | 18 | (2) | 40.8 |
| | | | | MAA | 2 | | |
| 20 | T | M-24 | 20 | MA | 20 | (10) | 52.1 |
| 21 | U | M-25 | 20 | BA | 20 | (1) | 50.8 |
| 22 | V | M-30 | 20 | MMA | 20 | (1) | 51.7 |
| 23 | W | Y-1 | 20 | BA | 30 | (10) | 41.5 |
| 24 | X | Y-5 | 20 | BA | 20 | (10) | 51.3 |
| 25 | Y | Y-10 | 20 | BA | 30 | (1) | 41.0 |

*1MA: Methyl Acrylate
BA: Butyl Acrylate
MAA: Methacrylic Acid
EA: Ethyl Acrylate
MMA: Methyl Methacrylate
DAAM: Diacetoneacrylamide The amounts of the monomer couplers and the comonomers in the above table indicate amounts used in the synthesis of the polymer couplers.

Dispersion of these polymer couplers in latexes can be carried out in the same manner as described in Synthesis Examples 1 to 6.

Organic solvents having a high boiling point which may be used together in the present invention are described, for example, in U.S. Pat. Nos. 2,322,027, 2,533,514 and 2,835,579, Japanese Patent Publication No. 23233/71, U.S. Pat. No. 3,287,134, British Pat. No. 958,441, Japanese Patent Application (OPI) No. 1031/72, British Pat. No. 1,222,753, U.S. Pat. No. 3,936,303, Japanese Patent Application (OPI) Nos. 26037/76 and 82078/75, U.S. Pat. Nos. 2,353,262, 2,852,383, 3,554,755, 3,676,137, 3,676,142, 3,700,454, 3,748,141 and 3,837,863, West German Patent Application (OLS) No. 2,538,889, Japanese Patent Application (OPI) Nos. 27921/76, 27922/76, 26035/76, 26036/76 and 62632/75, Japanese Patent Publication No. 29461/74, U.S. Pat. Nos. 3,936,303 and 3,748,141, Japanese Patent Application (OPI) No. 1521/78, etc.

As a binder or protective colloid for the photographic emulsion, it is advantageous to use gelatin, although other hydrophilic colloids can be used. For example, a protein, such as a gelatin derivative, a graft polymer of gelatin and other polymers, albumin, casein, etc.; a cellulose derivative, such as hydroxyethyl cellulose, carboxymethyl cellulose, and cellulose sulfate, etc.; a saccharide derivative, such as sodium alginate, a starch derivative, etc.; various synthetic hydrophilic high molecular weight substances such as homopolymers or copolymers, for example, polyvinyl alcohol, polyvinyl alcohol partial acetal, poly-N-vinyl pyrrolidone, polyacrylic acid, polymethacrylic acid, polyacrylamide, polyvinyl imidazole, polyvinyl pyrazole, etc., can be used.

In addition to lime-treated gelatin, acidtreated gelatin and enzyme-treated gelatin as described in *Bull. Soc. Sci. Phot. Japan,* No. 16, page 30 (1966) may be used as gelatin. Furthermore, the hydrolyzed product of gelatin and enzyme-decomposed product of gelatin may also be used.

Gelatin derivatives which can be used include those obtained by reacting gelatin with various compounds such as acid halides, acid anhydrides, isocyanates, bromoacetic acid, alkanesultones, vinylsulfonamides, maleimide compounds, polyalkylene oxides, epoxy compounds, etc. Specific examples thereof are described, for example, in U.S. Pat. Nos. 2,614,928, 3,132,945, 3,186,846 and 3,312,553, British Pat. Nos. 861,414, 1,033,189 and 1,005,784, Japanese Patent Publication No. 26845/67, etc.

Gelatin graft polymers which can be used include those which are obtained grafting homo- or copolymers of vinyl monomers such as acrylic acid, methacrylic acid, the ester or amide derivatives thereof, acrylonitrile, styrene, etc. to gelatin. In particular, graft polymers with a polymer having some compatibility with gelatin, such as polymers of acrylic acid methacrylic acid, acrylamide, methacrylamide, a hydroxyalkyl methacrylate, etc. are preferred. Specific examples thereof are described, for example, in U.S. Pat. Nos. 2,763,625, 2,831,767 and 2,956,884, etc.

Typical examples of synthetic hydrophilic high molecular weight substances are described, for example, in West German Patent Application (OLS) No. 2,312,708, U.S. Pat. Nos. 2,620,751 and 3,879,205, Japanese Patent Publication No. 7561/68, etc.

In the photographic emulsion layer of the photographic light-sensitive material used in the present invention, any of silver bromide, silver iodobromide, silver iodochlorobormide, silver chlorobromide, and silver chloride can be used as silver halide. A preferred example of silver halide is silver iodobromide containing 15 mole % or less of silver iodide. Particularly preferred silver halide is silver iodobromide containing from 2 to 12 mole % of silver iodide.

Although the average grain size of silver halide particles in the photographic emulsion is not critical, it is preferably 3 $\mu$ or less. The average grain size is determined herein with a grain diameter in those particles which are spherical or nearly spherical, and an edge length in those particles which are cubic as a grain size, and is expressed as an average value calculated from projected areas.

The distribution of grain size may be broad or narrow.

Silver halide particles in the photographic emulsion may have a regular crystal structure, e.g., a cubic or octahedral structure, an irregular crystal structure, e.g., a spherical or plate-like structure, or a complex crystal structure thereof. In addition, silver halide particles composed of those having different crystal structures may be used.

The inner portion and the surface layer of silver halide particles may be different in phase or may be of the same phase. These silver halide particles may be those in which a latent image is formed mainly on the surface thereof, or those in which a latent image is formed mainly in the interior thereof.

The photographic emulsion used in the present invention can be prepared in any suitable manner, e.g., by the methods described in P. Glafkides, *Chimie et Physique Photographique,* Paul Montel (1967), G.F. Duffin, *Photographic Emulsion Chemistry,* The Focal Press (1966), and V.L. Zelikman et al., *Making and Coating Photographic Emulsion,* The Focal Press (1964), etc. That is, any of an acid process, a neutral process, an ammonia process, etc. can be employed. Soluble silver salts and soluble halides can be reacted by techniques such as a single jet process, a double jet process, and a combination thereof. In addition, there can be employed a method (so-called reversal mixing process) in which silver halide particles are formed in the presence of an excess of silver ions.

As one system of the double jet processes, a so-called controlled double jet process in which the pAg in a liquid phase where silver halide is formed is maintained at a certain level can be employed. This process can produce a silver halide emulsion in which the crystal form is regular and the grain size is nearly uniform.

Two or more kinds of silver halide emulsions which are prepared separately may be used as a mixture.

The formation or physical ripening of silver halide particles may be carried out in the presence of cadmium salts, zinc salts, lead salts, thallium salts, iridium salts or complex salts thereof, rhodium salts or complex salts thereof, iron salts or complex salts thereof, and the like.

In order to remove soluble salts from the emulsion after precipitate formation or physical ripening, a noodle washing process in which gelatin gel is washed with water may be used. In addition, a flocculation process utilizing inorganic salts, anionic surface active agents, anionic polymers (e.g., polystyrenesulfonic acid, etc.), or gelatin derivatives (e.g., acrylated gelatin, carbamoylated gelatin, etc.) may be used.

The silver halide emulsion is usually chemically sensitized. For the chemical sensitization, for example, the methods described in H. Frieser ed., *Die Grundlagen der Photographischen Prozess mit Silberhalogeniden,* Akademische Verlagsgesellschaft, pages 675 to 734 (1968) can be used. More specifically, a sulfur sensitization process using active gelatin or compounds containing sulfur capable of reacting with silver (e.g., thiosulfates, thioureas, mercapto compounds, rhodanines, etc.), a reduction sensitization process using reducing substances (e.g., stannous salts, amines, hydrazine derivatives, formamidinesulfinic acid, silane compounds, etc.), a noble metal sensitization process using noble metal compounds (e.g., complex salts of Group VIII metals in the periodic table, such as Pt, Ir, Pd, etc. as well as gold complex salts), and so forth can be employed individually or in combination thereof.

Specific examples of the sulfur sensitization processes are described, for example, in U.S. Pat. Nos. 1,574,944, 2,410,689, 2,278,947, 2,728,668, and 3,656,955, etc., those of the reduction sensitization processes are described, for example, in U.S. Pat. Nos. 2,983,609, 2,419,974, and 4,054,458, etc., and those of the noble metal sensitization processes are described, for example, in U.S. Pat. Nos. 2,399,083 and 2,448,060, British Pat. No. 618,061, etc.

In the photographic emulsion used in the present invention can be incorporated various compounds for the purpose of preventing fog formation in the light-sensitive material during the production, storage or photographic processing thereof, or of stabilizing photographic properties. For example, those compounds known as antifoggants or stabilizers can be incorporated, including azoles such as benzothiazolium salts, nitroindazoles, triazoles, benzotriazoles, and benzimidazoles (particularly, nitro- or halogen-substitued compounds), etc.; heterocylic mercapto compounds such as mercaptothiazoles, mercaptobenzothiazoles, mercaptobenzimidazoles, mercaptotioadiazoles, mercaptotetrazoles (particularly, 1-phenyl-5-mercaptotetrazole), mercaptopyridines, etc.; the above-described heterocylic mercapto compounds further containing a water-soluble group, e.g., a carboxyl group or a sulfon group, etc.; thioketo compounds such as oxazolinethiones, etc.; azindenes such as tetraazaindens (particularly, 4-hydroxy-substituted (1,3,3*a*,7) tetraazaindens), etc.; benzenethiosulfonic acids; and benzenesulfinic acids, and the like.

In connection with specific examples and methods of using them, the descriptions for example, in U.S. Pat. Nos. 3,954,474, 3,982,947 and 4,021,248, Japanese Patent Publication No. 28660/77, etc. can be referred to.

In the photographic emulsion layer or other hydrophilic colloid layers of the light-sensitive material of the present invention can be incorporated various surface active agents as coating aids or for other various purposes, e.g., prevention of charging, improvement in slipping properties, improvement in emulsification and dispersion, prevention of adhesion, and improvement in photographic characteristics (Particularly development acceleration, high contrast, and sensitization).

Surface active agents which can be used include nonionic surface active agents, e.g., saponin (steroid-type), alkylene oxide derivatives (e.g., polyethylene glycol, polyethylene glycol/polypropylene glycol condensates, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, silicone/-polyethylene oxide adducts, etc.), glycidol derivatives (e.g., alkenylsuccinic acid polyglycerides, alkylphenol polyglycerides, etc.), fatty acid esters of polyhydric alcohols, alkyl esters of sugar, etc.; anionic surface active agents containing an acidic group, such as a carboxy group, a sulfo group, a phospho group, a sulfuric acid ester group, a phosphoric acid ester group, etc., for example, alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sufosuccinic acid esters, sulfoalkylpolyoxyethylene alkylphenyl ethers, polyoxyethylene alkylphosphoric acid esters, etc.; amphoteric surface active agents, such as aminoacids, aminoalkylsulfonic acids, aminoalkylsulfuric acid esters, aminoalkylphosphoric acid esters, alkylbetaines, amineoxides, etc. and cationic surface active agents, e.g., alkylamine salts, aliphatic or aromatic quaternary ammonium salts, heterocyclic quaternary ammonium salts (e.g., pyridinium, imidazolium, etc.), aliphatic or heterocyclic phosphonium or sulfonium salts, etc.

The photographic emulsion layer of the photographic light-sensitive material of the present invention may contain compounds such as polyalkylene oxides or derivatives thereof such as ethers, esters, amines or the like thioether compounds, thiomorpholines, quaternary ammonium salt compounds, urethane derivatives, urea derivatives, imidazole derivatives, 3-pyrazolidones, etc. for the purpose of increasing sensitivity or contrast, or of accelerating development. For example, the compounds described, for example, in U.S. Pat. Nos. 2,400,532, 2,423,549, 2,716,062, 3,617,280, 3,772,021 and 3,808,003, British Pat. No. 1,488,991, etc. can be used.

In the photographic emulsion layer or other hydrophillic colloid layers of the photographic light-sensitive material of the invention can be incorporated dispersions of water-insoluble or sparingly soluble synthetic polymers for the purpose of improving dimensional stability. Synthetic polymers which can be used include homopolymers or copolymers of alkyl acrylates or methacrylates, alkoxyalkyl acrylates or methacrylates, glycidyl acrylates or methacrylates, acrylamides or methacrylamides, vinyl esters (e.g., vinyl acetate, etc.), acrylonitrile, olefins, and styrene, and copolymers of the above-described monomers and acrylic acid, methacrylic acid, $\alpha$, 8-unsaturated dicarboxylic acids, hydroxyalkyl acrylates or methacrylates, sulfoalkyl acrylates or methacrylates, styrenesulfonic acid, etc. For example, the polymers as described in U.S. Pat. Nos. 2,376,005, 2,739,137, 2,853,457, 3,062,674, 3,411,911, 3,488,708, 3,525,620, 3,607,290, 3,635,715 and 3,645,740, British Pat. Nos. 1,186,699 and 1,307,373, etc. can be used.

In the photographic processing of a layer composed of photographic emulsion in the photographic light-sensitive material of the present invention, any of the known procedures and known processing solutions, e.g., those described in *Research Disclosure,* No. 176, pages 28 to 30 (RD-17643), can be used. The photographic processing may be a photographic processing (color photographic processing) to form dye images depending on the purpose. The processing temperature is usually selected from between 18° C. and 50° C., although it may be lower than 18° C. or higher than 50° C.

As the special developing technique, there may be used a method in which a developing agent is incorporated into the light-sensitive material, for example, in the emulsion layer, and the light-sensitive material is developed by treating in an alkali aqueous solution. Of the developing agents, hydrophobic compounds can be incorporated into the emulsion layer by various techniques, e.g., by the methods described in *Research Disclosure,* No. 169 (RD-16928), U.S. Pat. No. 2,739,890, British Pat. No. 813,253, West German Pat. No. 1,547,763, etc. Such a photographic processing may be performed in combination with a silver salt stabilizing process using a thiocyanate.

Any fixing solutions which are generally used can be used in the present invention. As fixing agents, thiosulfates thioxyanates, and in addition, organic sulfur compounds which are effectively known as fixing agents can be used. The fixing solution may contain water-soluble aluminum salts as hardeners.

Formation of dye images can be achieved by conventional methods. For example, a negative-positive method (described, for example, in *Journal of the Society of Motion Picture and Television Engineers,* Vol. 61, pages 667 to 701 (1953) can be employed.

Color developing solutions generally comprise alkaline aqueous solutions containing a color developing agent. As the color developing agents, known primary aromatic amine developing agents, e.g., phenylenediamines such as 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc. can be used.

In addition, the compounds described in L.F.A. Mason, *Photographic Processing Chemistry,* Focal Press, pages 226 to 229 (1966), U.S. Pat. Nos. 2,193,015 and 2,592,364, Japanese Patent Application (OPI) No. 64933/73, etc. may be used.

The color developing solution can further contain pH buffers, development inhibitors, antifoggants, and so forth. If desired, water-softening agents, preservatives, organic solvents, development accelerators, dye-forming couplers, competing couplers, fogging agents, auxiliary developing agents, viscosity increasing agents, polycarboxylic acid type chelating agents, antioxidants, and the like may be incorporated.

Specific examples of those additives are described, for example, in *Research Disclosure* (RD-17643), U.S. Pat. No. 4,083,723, and West German Patent (OLS) No. 2,622,950, etc.

After color development, the photographic emulsion layer is usually subjected to bleaching. The bleaching may be performed simultaneously with fixing, or it may be performed independently.

Bleaching agents which can be used include compounds of polyvalent metals, e.g., iron (III), cobalt (III), chromium (VI), and copper (II), peracids, quinones, nitroso compounds, etc. For example, ferricyanides; dichromates; organic complex salts of iron (III) or cobalt (III), e.g., complex salts of organic acids, such as aminopolycarboxylic acids (e.g., ethylenediaminetetraacetic acid, nitrilotriacetic acid, 1,3-diamino-2-propanoltetraacetic acid, etc.) or organic acids (e.g., citric acid, tartaric acid, and malic acid); persulfates; permanganates; and nitrosophenol can be used. Of these compounds, potassium ferricyanide, sodium iron (III) ethylenediaminetetraacetate, and ammonium iron (III) ethylenediaminetetraacetate are particularly useful. Ethylenediaminetetraacetic acid iron (III) complex salts are useful in both a bleaching solution and a mono-bath bleach-fixing solution.

In bleaching or bleach-fixing solutions can be incorporated various additives, such as bleach accelerators as described in U.S. Pat. Nos. 2,042,520 and 3,241,966, Japanese Patent Publication Nos. 8506/70 and 8836/70, and thiol compounds as described in Japanese Patent Application (OPI) No. 65732/78, etc.

The photographic emulsion used in the present invention may be spectrally sensitized with methine dyes or other dyes.

Useful sensitizing dyes are described, for example, in German Pat. No. 929,080, U.S. Pat. Nos. 2,493,748, 2,503,776, 2,519,001, 2,912,329, 3,656,959, 3,672,897 and 4,025,349, British Pat. No. 1,242,588, Japanese Patent Publication No. 14030/69, etc. These sensitizing dyes may be used individually, and they may be used in combination thereof. Combinations of sensitizing dyes are often used particularly for the purpose of super sensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,814,609 and 4,026,707, British Pat. No. 1,344,281, Japanese Patent Publication Nos. 4936/68 and 12375/78, Japanese Patent Publication (OPI) Nos. 110618/77 and 109925/77, etc.

In the photographic light-sensitive material of the present invention, the photographic emulsion layer and other layers can be coated on a flexible support, e.g., a plastic film, paper, cloth, etc. or a rigid support, e.g., glass, ceramics, metal, etc. Useful examples of flexible supports include films made of semisynthetic or synthetic polymers, such as cellulose nitrate, cellulose acetate, cellulose acetate butyrate, polystyrene, polyvinyl chloride, polyethylene terephthalate, polycarbonate, etc. and paper coated or laminated with a baryta layer or an α-olefin polymer (e.g., polyethylene, polypropylene, and an ethylene/butene copolymer). These supports may be colored with dyes or pigments, or be made black for the purpose of shielding light. The surface of the supports is generally subjected to a subbing treatment to improve its adhesion to a photographic emulsion layer, etc. Before or after the subbing treatment, the surface of supports may be subjected to corona discharge, ultraviolet ray irradiation, flame treatment, and the like.

In the photographic light-sensitive material of the present invention, the photographic emulsion layer and other hydrophilic colloid layers can be coated on a support or another layer by any known coating techniques, such as a dip coating method, a roller coating method, a curtain coating method, an extrusion coating method, etc. It is advantageous to use the methods as described in U.S. Pat. Nos. 2,681,294, 2,761,791 and 3,526,528.

The present invention can be applied to a multi-layer multi-color photographic light-sensitive material containing at least two layers having different spectral sensitivities. The multi-layer natural color photographic light-sensitive material usually comprises a support having thereon at least one red-sensitive emulsion layer, at least one green-sensitive emulsion layer, and at least one blue-sensitive emulsion layer. These emulsion layers can be provided in any desired order. Usually, a cyan-forming coupler is incorporated in the red-sensitive emulsion layer, a magenta-forming coupler is incorporated in the green-sensitive emulsion layer, and a yellow-forming coupler is incorporated in the blue-sensitive emulsion layer. In some cases, different combinations can be used.

The color photographic light-sensitive material of the present invention is exposed to light to form a photographic image in the usual manner. For the exposure, a wide variety of known light sources, such as natural light (sun light), a tungsten lamp, a fluorescent lamp, a mercuryl lamp, a xenon arc lamp, a carbon arc lamp, a xenon flash lamp, and a cathode ray tube flying spot, can be used. The exposure time may be, as a matter of course, from 1/1,000 second to 1 second, which is used for usual cameras, or may be shorter than 1/1,000 second, for example, from $1/10^4$ second to $1/10^6$ second using a xenon flash lamp or a cathode ray tube. In addition, it may be longer than 1 second. If desired a color filter can be used to control the spectral composition of light to be used for exposure. A laser beam can also be used. In addition, the photographic light-sensitive material of the present invention may be exposed to light emitted from a phosphor excited by electron beam, X-ray, $\gamma$-ray, $\alpha$-ray, etc.

In the photographic emulsion layer of the photographic light-sensitive material of the present invention, conventional color-forming couplers, that is, compounds capable of forming color upon oxidative coupling with aromatic primary amine developing agents (e.g., phenylenediamine derivatives, aminophenol derivatives, etc.) in color development processing may be used in the same layer or other emulsion layers together with the polymer coupler. Examples of magenta couplers include a 5-pyrazolone coupler, a pyrazolobenzimidazole coupler, a cyano acetylcumaron coupler, an open-chain acylacetonitrile coupler; examples of yellow couplers include an acylacetamide coupler (e.g., a benzoylacetanilide, a pivaloylacetanilide, etc.); and examples of cyan couplers include a naphthol coupler, a phenol coupler, etc. It is desirable that these couplers have a hydrophobic group called a ballast group in the molecule thereof, in order to render non-diffusible. The couplers may be either of four equivalent and two equivalent per silver ion. In addition, they may be colored couplers having a color correction effect, or couplers (so-called DIR couplers) releasing a development inhibitor as development. Other than DIR couplers, non-color forming DIR coupling compounds, the coupling reaction products of which are colorless, and which release a development inhibitor may be incorporated.

Specific examples of magenta color forming couplers used are described, for example, in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German Patent Application (OLS) Nos. 2,408,665, 2,417,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76 and 55122/78, etc.

Specific examples of yellow color forming couplers used are described, for example, in U.S. Pat. Nos. 2,875,057, 3,265,506, 3,408,194, 3,551,155, 3,582,322, 3,725,072 and 3,891,445, West German Pat. No. 1,547,868, West German Patent Application (CDLS) Nos. 2,219,917, 2,261,361 and 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77 and 115219/77, etc.

Specific examples of cyan color forming couplers used are described, for example, in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German Patent Application (OLS) Nos. 2,414,830 and 2,454,329, Japanese Patent Application (OPI) Nos. 59838/73, 26034/76, 5055/73, 146828/76, 69624/77 and 90932/77, etc.

Colored couplers which can be used are described, for example, in U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 42121/77, West German Patent Application (OLS) No. 2,418,959, etc.

DIR couplers which can be used are described, for example, in U.S. Pat. Nos. 3,227,554, 3,617,291, 3,701,783, 3,790,384 and 3,632,345, West German Patent Application (OLS) Nos. 2,414,006, 2,454,301 and 2,454,329, British Pat. No. 953,454, Japanese Patent Application (OPI) Nos. 69624/77 and 122335/74, Japanese Patent Publication No. 16141/76, etc.

In addition to DIR couplers, compounds capable of releasing a development inhibitor as development can be incorporated in the photographic light-sensitive material. For example, the compounds described, for example, in U.S. Pat. Nos. 3,297,445 and 3,379,529, West German Patent Application (OLS) No. 2,417,914, Japanese Patent Application (OPI) Nos. 15271/77 and 9116/78, etc. can be used.

The photographic light-sensitive material of the present invention may contain inorganic or organic hardeners in the photographic emulsion layer and other hydrophilic colloid layers thereof. For example, chromium salts (e.g., chromium alum, chromium acetate, etc.), aldehydes (e.g., formaldehyde, glyoxal, glutaraldehyde, etc.), N-methlol ccmpounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acids (e.g., muchochloric acid, mucophenoxychloric acid, etc.) can be used alone or in combination thereof.

In the photographic light-sensitive material of the present invention, when dyes, ultraviolet ray absorbing agents, and the like are incorporated in the hydrophilic colloid layers, they may be mordanted with cationic polymers, etc. For this purpose, the polymers described, for example, in British Pat. No. 685,475, U.S. Pat. nos. 2,675,316, 2,839,401, 2,882,156, 3,048,487, 3,184,309 and 3,445,231, West German Patent Application (OLS) No. 1,914,362, Japanese Patent Application (OPI) Nos. 47624/75 and 71332/75, etc. can be used.

The photographic light-sensitive material of the present invention may contain hydroquinone derivatives, aminophenol derivatives, gallic acid derivatives, ascorbic acid derivatives, etc. as color fog preventing agents.

The photographic light-sensitive material of the present invention may contain ultraviolet ray absorbing agents in the hydrophilic colloid layer thereof. Ultraviolet ray absorbing agents which can be used include benzotriazole compounds substituted with an aryl group, 4-thiazolidone compounds, benzophenone compounds, cinnamic acid ester compounds, butadiene compounds, benzoxazole compounds, and the like. In addition, polymers having an ultraviolet ray absorbing ability can be used. These ultraviolet ray absorbing agents may be fixed in the above-described hydrophilic colloid layer.

Specific examples of the ultraviolet ray absorbing agents used are described, for example, in U.S. Pat. Nos. 3,533,794, 3,314,794 and 3,352,681, Japanese Patent Application (OPI) No. 2784/71, U.S. Pat. Nos. 3,705,805, 3,707,375, 4,045,229, 3,700,455 and 3,499,762, West German Patent Publication No. 1,547,863, etc.

The photographic light-sensitive material of the present invention may contain water-soluble dyes in the hydrophilic colloid layer as filter dyes or for various purposes, e.g., irradiation prevention. Examples of such dyes include oxonol dyes, hemioxonol dyes, styryl dyes, merocyanine dyes, cyanine dyes and azo dyes. In particular, oxonol dyes, hemioxonol dyes and merocyanine dyes are useful.

In addition, known color fading preventing agents as described below can be used together with in the present invention. Color image stabilizers used in the present invention can be used individually or in combination thereof. Known color fading preventing agents used include hydroquinone derivatives, gallic acid derivatives, p-alkoxyphenols, p-oxyphenol derivatives, bisphenols, etc.

Specific examples of the hydroquinone derivatives are described, for example, in U.S. Pat. Nos. 2,360,290, 2,418,613, 2,675,314, 2,701,197, 2,704,713, 2,728,659, 2,732,300, 2,735,765, 2,710,801 and 2,816,028, British Pat. No. 1,363,921, etc. Examples of the gallic acid derivatives are described, for example, in U.S. Pat. Nos. 3,432,300, 3,573,050, 3,574,627 and 3,764,337, Japanese Patent Application (OPI) Nos. 35633/77, 147434/77 and 152225/77, etc. Examples of the bisphenols are described, for example, in U.S. Pat. No. 3,700,455.

The present invention will be explained in greater detail with reference to the examples below, but the present invention should not be construed as being limited thereto.

EXAMPLE 1

Preparation of Sample 101

On a cellulose triacetate film support were coated layers having the compositions set forth below to prepare a color photographic light-sensitive material.

First Layer: Emulsion Layer

A silver iodobromide emulsion (iodide content: 4 mol %, average particle size: 0.5 microns).

Polymer Coupler (N) silver coated amount: 1.0 g/m$^2$; $1\times10^{-3}$ mol/m$^2$ (based on the color forming unit)

Second Layer: Protective Layer

A gelatin layer containing polymethyl methacrylate particles (having a diameter of about 1.5 microns).

The polymer coupler used in the emulsion layer was prepared by dissolving it in a mixture composed of tricresyl phosphate and ethyl acetate, the solution was mixed with an aqueous gelatin solution containing sodium p-dodecylbenzenesulfonate and the mixture was emulsified using a homoblender. The amount of the tricresyl phosphate employed was 20% by weight of the coupler.

A gelatin hardener and a surface active agent were incorporated into each of the layers in addition to the above described compositions.

The thus-prepared sample was designated Sample 101.

PREPARATION OF SAMPLES 102 TO 112

Samples 102 to 112 were prepared in the same manner as Sample 101 except that the kind of the polymerization initiator used for the preparation of polymer Couplers (N) and (F) was changed as shown in Table 1 below.

PREPARATION OF SAMPLE 113

Sample 113 was prepared in the same manner as Sample 101 except that Polymer Coupler (A) prepared in Synthesis Example 1 was used in place of Polymer Coupler (N).

Samples 101 to 113 thus obtained were exposed to white light using a step wedge and subjected to the following development processing at 38° C.

| | |
|---|---|
| 1. Color Development | 3 min 15 sec |
| 2. Bleaching | 6 min 30 sec |
| 3. Washing with Water | 3 min 15 sec |
| 4. Fixing | 6 min 30 sec |
| 5. Washing with Water | 3 min 15 sec |
| 6. Stabilizing | 3 min 15 sec |

The processing solutions used in the above steps had the following compositions:

| | |
|---|---|
| Color Developing Solution | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β-hydroxyethylamino)-2-methylaniline Sulfate | 4.5 g |
| Water to make | 1 l |
| Bleaching Solution | |
| Ammonium Bromide | 160.0 g |
| Ammonia (28% aq. soln) | 25.0 ml |
| Sodium Ferric Ethylenediamine-tetraacetate | 130.0 g |
| Glacial Acetic Acid | 14.0 ml |
| Water to make | 1 l |
| Fixing Solution | |
| Sodium Tetrapolyphosphate | 2.0 g |
| Sodium Sulfite | 4.0 g |
| Ammonium Thiosulfate (70% aq. soln.) | 175.0 m |
| Sodium Bisulfite | 4.6 g |
| Water to make | 1 l |
| Stablizing Solution | |
| Formalin | 8.0 ml |
| Water to make | 1 l |

The results thus obtained are shown in Table 1 below. It is apparent from the results shown in Table 1 that the samples according to the present invention exhibit a low level of fog and the preferred photographic characteristics while the samples using Polymerization Initiators (A), (B) and (C) for comparison have an extremely high fog.

TABLE 1

| Sample No. | Polymer Coupler | Polymerization Initiator | Fog |
|---|---|---|---|
| 101 | N | (1) | 0.10 |
| 102 | N | (2) | 0.10 |
| 103 | N | (10) | 0.11 |
| 104 | N | (A) | 0.32 |
| 105 | N | (B) | 0.35 |
| 106 | N | (C) | 0.35 |
| 107 | F | (1) | 0.08 |
| 108 | F | (2) | 0.08 |

TABLE 1-continued

| Sample No. | Polymer Coupler | Polymerization Initiator | Fog |
|---|---|---|---|
| 109 | F | (4) | 0.08 |
| 110 | F | (A) | 0.19 |
| 111 | F | (B) | 0.24 |
| 112 | F | (C) | 0.24 |
| 113 | A | (1) | 0.08 |

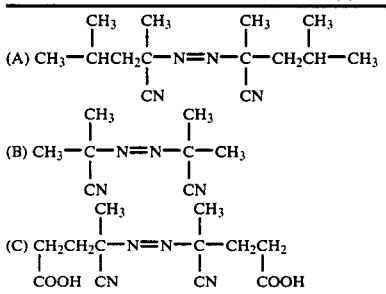

EXAMPLE 2

Preparation of Sample 201

On a cellulose triacetate film support were coated layers having the compositions set forth below to prepare a multilayer color photographic light-sensitive material.

First Layer: Antihalation Layer

A gelatin layer containing black colloidal silver.

Second Layer: Intermediate Layer

A gelatin layer containing a dispersion of 2,5-di-tert-octylhydroquinone

Third Layer: Red-sensitive Low Speed Emulsion Layer

A silver iodobromide emulsion (iodide content: 5 mol %, average particle size: 0.5 microns) silver coated amount: 1.79 g/m$^2$ Sensitizing Dye I: $6\times10^{-5}$ mol per mol of silver Sensitizing Dye II: $1.5\times10^{-5}$ mol per mol of silver Coupler A: 0.06 mol per mol of silver Coupler C: 0.003 mol per mol of silver Coupler D: 0.003 mol per mol of silver Tricresyl Phosphate (coated amount): 0.3 cc/m$^2$ Fourth Layer: Red-Sensitive High Speed Emulsion Layer A silver iodobromide emulsion (iodide content: 4 mol %, average particle size: 0.7 microns); silver coated amount: 1.4 g/m$^2$ Sensitizing Dye I: $3\times10^{-5}$ mol per mol of silver Sensitizing Dye II: $1.2\times10^{-5}$ mol per mol of silver Coupler E: 0.011 mol per mol of silver Coupler C: 0.0016 mol per mol of silver Tricresyl Phosphate (coated amount): 0.3 cc/m$^2$ Fifth Layer: Intermediate Layer Same as the Second Layer Sixth Layer: Green-Sensitive Low Speed Emulsion Layer A silver iodobromide emulsion (iodide content: 4 mol %, average particle size: 0.5 microns); silver coated amount: 1.0 g/m$^2$ Sensitizing Dye III: $3\times10^{-5}$ mol per mol of silver Sensitizing Dye IV: $1\times10^{-5}$ mol per mol of silver Polymer Coupler (O): 0.08 mol per mol of silver (based on the color forming unit)

Coupler M: 0.008 mol per mol of silver

Coupler D: 0.0015 mol per mol of silver

Tricresyl Phosphate (coated amount): 0.5 cc/m$^2$

Seventh Layer: Green-Sensitive High Speed Emulsion Layer

A silver iodobromide emulsion (iodide content 5 mol %, average particle size: 0.75 microns); silver coated amount: 1.6 g/m$^2$ Sensitizing Dye III: $2.5\times10^{-5}$ mol per mole of silver Sensitizing Dye IV: $0.8\times10^{-5}$ mol per mole of silver Coupler B: 0.02 mol per mol of silver Coupler M: 0.003 mol per mol of silver Tricresyl Phosphate (coated amount): 0.8 cc/m$^2$ Eight Layer: Yellow Filter Layer A gelatin layer containing yellow colloidal silver and a dispersion of 2,5-di-tert-octylhydroquinone Ninth Layer: Blue-Sensitive Low Speed Emulsion Layer A silver iodobromide emulsion (iodide content: 6 mol %, average particle size: 0.7 microns); silver coated amount: 0.5 g/m$^2$ Coupler Y: 0.125 mol per mol of silver Tricresyl Phosphate (coated amount): 0.3 cc/m$^2$ Tenth Layer: Blue-Sensitive High Speed Emulsion Layer A silver iodobromide emulsion (iodide content: 6 mol %, average particle size: 0.8 microns) silver coated amount: 0.6 g/m$^2$ Coupler Y: 0.04 mol per mol of silver Tricresyl Phosphate (coated amount): 0.1 cc/m$^2$ Eleventh Layer: Protective Layer A gelatin layer containing polymethyl methacrylate particles (having a diameter of about 1.5 microns)

The couplers in each of the emulsion layers were emulsified in the same manner as described in Example 1 and employed.

A gelatin hardener and a surface active agent were incorporated into each of the layers in addition to the above described components.

The thus-prepared sample was designated Sample 201.

The compounds used for the preparation of the above-described sample were as follows:

Sensitizing Dye I:

Pyridinium salt of anhydro-5,5'-dichloro-3,3'-di-(γ-sulfopropyl)-9-ethylthiacarbocyanine hydroxide Sensitizing Dye II:

Triethylamine salt of anhydro-9-ethyl-3,3'-di-(γ-sulfopropyl)-4,5,4',5'-dibenzothiacarbocyanine hydroxide Sensitizing Dye III:

Sodium salt of anhydro-9-ethyl-5,5'-dichloro-3,3'-di(γ-sulfopropyl)oxacarbocyanine Sensitizing Dye IV:

Sodium salt of anhydro-5,6,6',6'-tetrachloro-1,1'-diethyl-3,3'-di{β-[β-(γ-sulfopropoxy)ethoxy]ethyl}-imidazolocarbocyanine hydroxide Coupler A

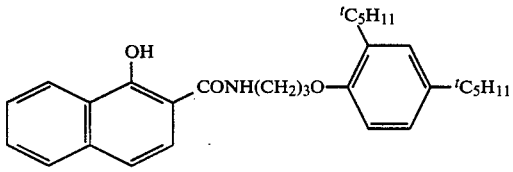

-continued
Coupler B
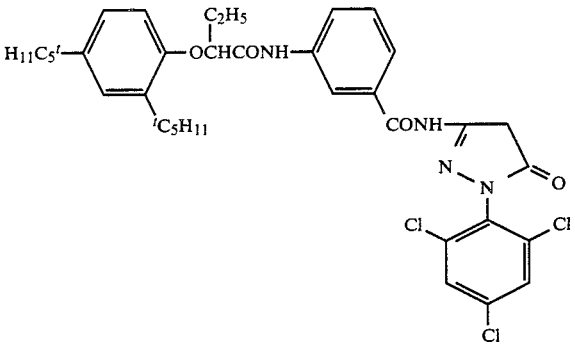
Coupler C
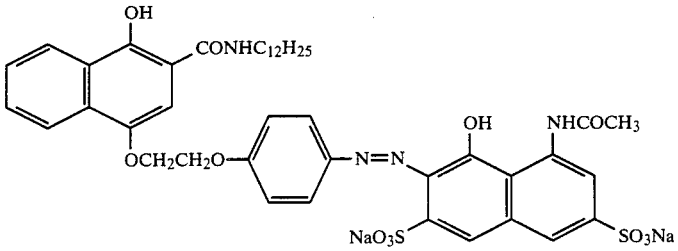
Coupler D
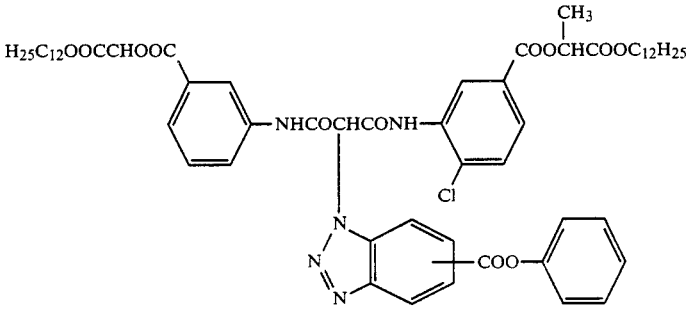
Coupler E
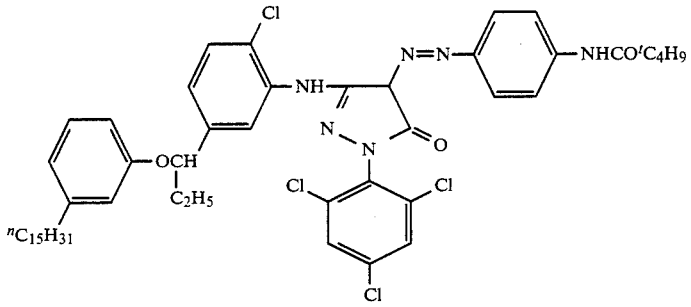
Coupler M
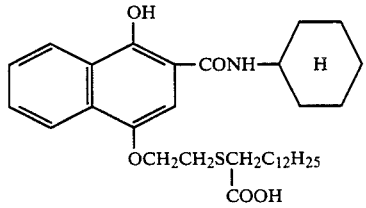

-continued

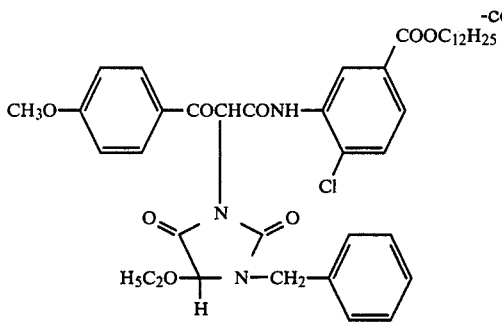

Coupler Y

PREPARATION OF SAMPLES 202 to 205

Samples 202 to 205 were prepared in the same manner as Samples 201 except that the kind of the polymerization initiator used for the preparation of Polymer Coupler (O) was changed as shown in Table 2 below.

These samples were stored under the conditions of 40° C. and 80% RH and in a freezer respectively and then exposed and subjected to development processing in the same manner as described in Example 1 in order to determine the effect of storage on magenta color images. The results obtained are shown in Table 2 below.

TABLE 2

| Sample No. | Polymer Coupler | Poly-merization Initiator | Fog | Change in Sensitivity* after Storage at 40° C., 80% RH for 7 days |
|---|---|---|---|---|
| 201 | 0 | (1) | 0.03 | −0.04 |
| 202 | 0 | (2) | 0.03 | −0.05 |
| 203 | 0 | (10) | 0.03 | −0.04 |
| 204 | 0 | (A) | 0.05 | −0.12 |
| 205 | 0 | (B) | 0.06 | −0.13 |
| 206 | 0 | (C) | 0.06 | −0.14 |

*Change in Log E at the point having density of fog +0.2 in the green-sensitive layer.

It is apparent from the results shown in Table 2 that the samples in which the polymerization initiator according to the present invention is used exhibit a low level of fog and very small desensitization after the storage at 40° C. and 80% RH for 7 days.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon a silver halide emulsion layer containing a polymer coupler which is capable of forming a dye upon coupling with an oxidation product of an aromatic primary amine developing agent and which is polymerized using a polymerization initiator represented by the following general formula (I):

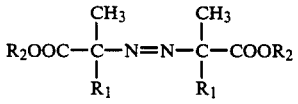

wherein $R_1$ represents a straight chain or branched chain alkyl group having from 1 to 5 carbon atoms; and $R_2$ represents a straight chain or branched chain alkyl group having from 1 to 20 carbon atoms, wherein the polymer coupler is a polymer or copolymer having a repeating unit derived from a monomer represented by the following general formula (II):

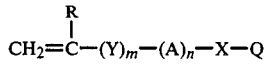

wherein R represent a hydrogen atom, a lower alkyl group having from 1 to 4 carbon atoms, or a chlorine atom; X represents —CONH—, —NHCOHN—, —NHCOO—, —COO—, —$SO_2$—, —CO or —O—; Y represents —CONH— or —COO—; A represents an unsubstituted or substituted alkylene group having from 1 to 10 carbon atoms, an unsubstituted or substituted aralkylene group or an unsubstituted or substituted arylene group; Q represents a cyan color forming coupler residue, a magenta color forming coupler residue or a yellow color forming coupler residue each of which is capable of forming a dye upon coupling with an oxidation product of an aromatic primary amine developing agent; m represents 0 or 1; and n represents 0 or 1.

2. A silver halide color photographic light-sensitive material as claimed in claim 1, wherein the substituent for the alkylene group, the aralkylene group or the arylene group represented by A is an aryl group, a nitro group, a hydroxy group, a cyano group, a sulfo group, an alkoxy group, an aryloxy group, an acyloxy group, an acylamino group, a sulfonamido group, a sulfamoyl group, a halogen atom, a carboxy group, a carbamoyl group, an alkoxycarbonyl group, or a sulfonyl group.

3. A silver halide color photographic light-sensitive material as claimed in claim 1, wherein Q is a cyan color forming coupler residue represented by the following general formula (IV) or (V):

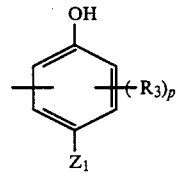

(IV)

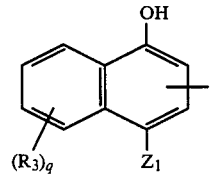

(V)

wherein $R_3$ represents an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an arylcarbamoyl group, an arylamido group, an arylsulfamoyl group, an arylsufonamido group or an arylureido group; p represents 0 or an integer from 1 to 3; q represents 0 or an integer from 1 to 4; and $Z_1$ represents a hydrogen atom, a halogen atom, a sulfo group, an acyloxy group, an alkoxy group, an aryloxy group, a heterocyclic oxy group, an alkylthio group, an arylthio group or a heterocyclic thio group.

4. A silver halide color photographic light-sensitive material as claimed in claim 3, wherein a substituted for the group represented by $Z_1$ is an aryl group, a nitro group, a hydroxy group, a cyano group, a sulfo group, an alkoxy group, an aryloxy group, an acyloxy group, an acylamino group, an alkylsulfonamido group, an alkylsulfamoyl group, a halogen atom, a carboxy group, an alkylcarbamoyl group, an alkoxycarbonyl group, an alkylsulfonyl group or an alkylthio group.

5. A silver halide color photographic light-sensitive material as claimed in claim 1, wherein Q is a magenta color forming coupler residue represented by the following general formula (VI):

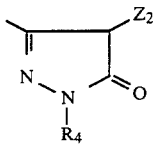

(VI)

wherein $R_4$ represents an unsubstituted or substituted alkyl group or an unsubstituted or substituted aryl group; and $Z_2$ represents a hydrogen atom or a releasable group containing an oxygen atom, a nitrogen atom or a sulfur atom through which it is bonded to the coupling position.

6. A silver halide color photographic light-sensitive material as claimed in claim 5, wherein the substituent for the substituted aryl group represented by $R_4$ is an alkyl group, an alkoxy group, an aryloxy group, an alkoxycarbonyl group, an acylamino group, a carbamoyl group, an alkylcarbamoyl group, a dialkylcarbamoyl group, an arylcarbamoyl group, an alkylsulfonyl group, an arylsulfonyl group, an alkylsulfonamido group, an arylsulfonamido group, a sulfamoyl group, an alkylsulfamoyl group, a dialkylsulfamoyl group, an alkylthio group, an arylthio group, a cyano group, a nitro group, or a halogen atom.

7. A silver halide color photographic light-sensitive material as claimed in claim 5, wherein the substituent for the substituted aryl group represented by $R_4$ is a halogen atom, an alkyl group, an alkoxy group, an alkoxycarbonyl group, or a cyano group.

8. A silver halide color photographic light-sensitive material as claimed in claim 5, wherein the group capable of being released is a group in which the oxygen atom, nitrogen atom or sulfur atom is bonded to an alkyl group, an aryl group, an alkyl sulfonyl group, an arylsulfonyl group, an alkylcarbonyl group, an arylcarbonyl group or a heterocyclic group.

9. A silver halide color photographic light-sensitive material as claimed in claim 5, wherein the group capable of being released is a 5-membered or 6-membered ring containing a nitrogen atom which is bonded to the coupling position.

10. A silver halide color photographic light-sensitive material as claimed in claim 1, wherein Q is a yellow color forming coupler residue represented by the following general formula (VII), (VIII) or (IX):

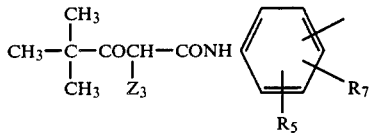

(VII)

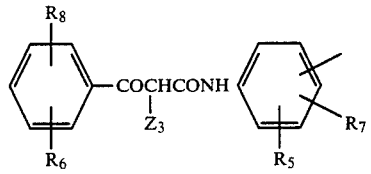

(VIII)

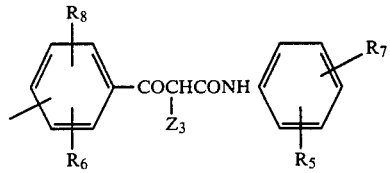

(IX)

wherein $R_5$, $R_6$, $R_7$ and $R_8$ each represents a hydrogen atom, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkylsubstituted succinimido group, an aryloxy group, an aryloxycarbonyl group, an arylcarbamoyl group, an arylamido group, an arylsulfamoyl group, an arylsulfonamido group, an arylureido group, a carboxy group, a sulfo group, a nitro group, a cyano group or a thiocyano group; and $Z_3$ represents a hydrogen atom or a group represented by the general formula (X), (XI), (XII) or (XIII) described below:

$OR_9$ [X]

wherein $R_9$ represents an aryl group which may be substituted or a heterocyclic group which may be substituted,

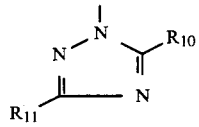

(XI)

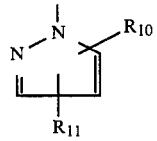

(XII)

wherein $R_{10}$ and $R_{11}$, which may be the same or different, each represents a hydrogen atom, a halogen atom, a carboxylic acid ester group, an amido group, an alkyl group, an alkylthio group, an alkoxy group, an alkylsulfonyl group, an alkylsulfinyl group, a carboxylic acid group, a sulfonic acid group, an unsubstituted or substituted phenyl group or an unsubstituted or substituted heterocyclic group, (XIII)

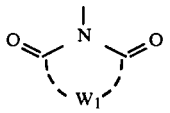

wherein $W_1$ represents non-metallic atoms necessary to form a 4-membered, 5-membered or 6-membered ring together with

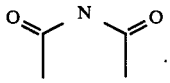

11. A silver halide color photographic light-sensitive material as claimed in claim 10, wherein the group represented by the general formula (XIII) is a group represented by the following general formula (XIV), (XV) or (XIII):

(XIV)

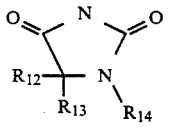

(XV)

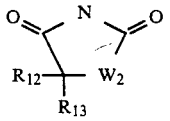

(XVI)

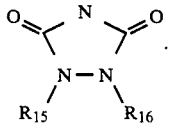

wherein $R_{12}$ and $R_{13}$ each represents a hydrogen atom, an alkyl group, an aryl group, an alkoxy group, an aryloxy group or a hydroxy atom; $R_{14}$, $R_{15}$ and $R_{16}$ each represents a hydrogen atom, an alkyl group, an aryl group, an aralkyl group or an acyl group; and $W_2$ represents an oxygen atom or a sulfur atom.

12. A silver halide color photographic light-sensitive material as claimed in claim 1, wherein the polymer is a homopolymer.

13. A silver halide color photographic light-sensitive material as claimed in claim 1, wherein the polymer is a copolymer.

14. A silver halide color photographic light-sensitive material as claimed in claim 13, wherein the copolymer contains a repeating unit derived from a noncolor forming monomer which does not couple with the oxidation product of an aromatic primary amine developing agent.

15. A silver halide color photographic light-sensitive material as claimed in claim 14, wherein the non-color forming monomer is an acrylic acid, an ester of acrylic acid, an amide of acrylic acid, a vinyl ester, an acrylonitrile, an aromatic vinyl compound, itaconic acid, citraconic acid, crotonic acid, vinylidene chloride, a vinyl alkyl ether, maleic acid, maleic anhydride, an ester of maleic acid, N-vinyl-2-pyrrolidone, N-vinyl pyridine, or 2- or 4-vinyl pyridine.

16. A silver halide color photographic light-sensitive material as claimed in claim 14, wherein the non-color forming monomer is an acrylic acid ester, a methacrylic acid ester or a maleic acid ester.

17. A silver halide color photographic light-sensitive material as claimed in claim 1, wherein the amount of the color forming portion in the polymer coupler is from 5% to 80% by weight.

18. A silver halide color photographic light-sensitive material as claimed in claim 1, wherein the amount of the color forming portion in the polymer coupler is from 20% to 70% by weight.

19. A silver halide color photographic light-sensitive material as claimed in claim 17, wherein the gram number of the polymer coupler containing 1 mol of coupler monomer is from 250 to 4,000.

20. A silver halide color photographic light-sensitive material as claimed in claim 1, wherein the polymer coupler is present in the form of a latex.

21. A silver halide color photographic light-sensitive material as claimed in claim 20, wherein the latex of the polymer coupler is a latex prepared by dissolving an oleophilic polymer coupler obtained by polymerization of a monomer comprising a monomer coupler represented by the general formula (II) in an organic solvent and then dispersing the solution in a latex form in an aqueous gelatin solution.

22. A silver halide color photographic light-sensitive material as claimed in claim 1, wherein the polymer coupler is a magenta color image forming polymer coupler.

23. A silver halide color photographic light-sensitive material as claimed in claim 22, wherein the silver halide emulsion layer containing the magenta color image forming polymer coupler is a red-sensitive silver halide emulsion layer.

24. A silver halide color photographic light-sensitive material as claimed in claim 23, wherein the photographic light-sensitive material further comprises a blue-sensitive silver halide emulsion layer containing a yellow color image forming coupler and a red-sensitive silver halide emulsion layer containing a cyan color image forming coupler.

25. A silver halide color photographic light-sensitive material as claimed in claim 3, wherein the cyan color forming coupler residue is represented by the formula:

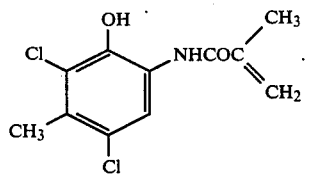

26. A silver halide color photographic light-sensitive material as claimed in claim 5, wherein the magenta color forming coupler residue is represented by the general formula:

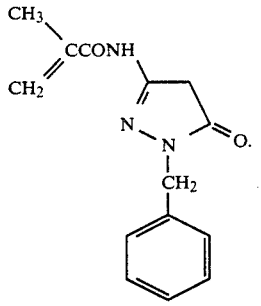

27. A silver halide color photographic light-sensitive material as claimed in claim 10, wherein the yellow color forming coupler residue is represented by the formula:

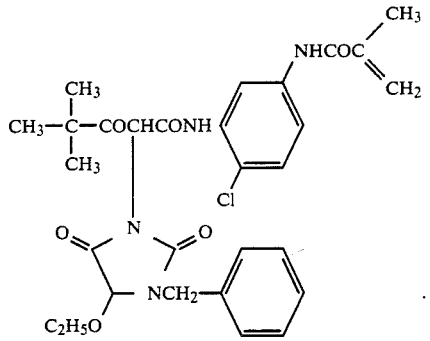

28. A silver halide color photographic light-sensitive material as claimed in claim 1, wherein $R_2$ has 1 to 8 carbon atoms.

29. A silver halide color photographic light-sensitive material as claimed in claim 1, wherein $R_2$ has 1 to 5 carbon atoms.

30. A silver halide color photographic light-sensitive material as claimed in claim 1, wherein $R_2$ has 1 or 2 carbon atoms.

31. A silver halide color photographic light-sensitive material as claimed in claim 1, wherein $R_2$ is selected from the group consisting of methyl, ethyl, propyl, isopropyl, n-butyl, isohbutyl, n-pentyl and n-octyl.

32. A silver halide color photographic light-sensitive material as claimed in claim 1, wherein $R_2$ is methyl.

33. A silver halide color photographic light-sensitive material as claimed in claim 1, wherein $R_2$ is ethyl.

34. A silver halide color photographic light-sensitive material as claimed in claim 1, wherein $R_2$ is propyl or isopropyl.

35. A silver halide color photographic light-sensitive material as claimed in claim 1, wherein $R_2$ is n-butyl or isobutyl.

36. A silver halide color photographic light-sensitive material as claimed in claim 1, wherein $R_2$ is n-pentyl.

37. A process for preparing a silver halide color photographic light-sensitive material comprising a support having thereon a silver halide emulsion layer containing a polymer coupler which is capable of forming a dye upon coupling with an oxidation product of an aromatic primary amine developing agent, which process comprises polymerizing said polymer coupler using a polymerization initiator represented by general formula (I) and thereafter adding the same to said silver halide emulsion layer and coating said silver halide emulsion layer on said support;

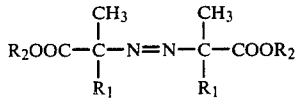

(I)

wherein $R_1$ represents a straight chain or branched chain alkyl group having from 1 to 5 carbon atoms; and $R_2$ represents a straight chain or branched chain alkyl group having from 1 to 20 carbon atoms, wherein the polymer coupler is a polymer or copolymer having a repeating unit derived from a monomer represented by the following general formula (II):

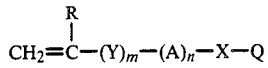

(II)

wherein R represents a hydrogen atom, a lower alkyl group having from 1 to 4 carbon atoms, or a chlorine atom; X represents —CONH—, —NHCOHN—; —NHCOO—, —COO—, —$SO_2$—, —CO or —O—; Y represents —CONH— or —COO—; A represents an unsubstituted or substituted alkylene group having from 1 to 10 carbon atoms, an unsubstituted or substituted aralkylene group or an unsubstituted or substituted arylene group; Q represents a cyan color forming coupler residue, a magenta color forming coupler residue or a yellow color forming coupler residue each of which is capable of forming a dye upon coupling with an oxidation product of an aromatic primary amine developing agent; m represents 0 to 1; and n represents 0 to 1.

* * * * *